US011810531B1

(12) United States Patent
Yi et al.

(10) Patent No.: US 11,810,531 B1
(45) Date of Patent: Nov. 7, 2023

(54) METHODS AND SYSTEMS FOR CALIBRATING AND CONTROLLING A DISPLAY DEVICE

(71) Applicant: Pixelworks Semiconductor Technology (Shanghai) Co. Ltd., Shanghai (CN)

(72) Inventors: Wenwen Yi, Shanghai (CN); Haiyan Shi, Shanghai (CN); Neil Woodall, Newport Beach, CA (US)

(73) Assignee: Pixelworks Semiconductor Technology (Shanghai) Co., Ltd., Shanghai (CN)

( * ) Notice: Subject to any disclaimer, the term of this patent is extended or adjusted under 35 U.S.C. 154(b) by 0 days.

(21) Appl. No.: 17/661,250

(22) Filed: Apr. 28, 2022

(51) Int. Cl.
*G09G 5/10* (2006.01)
*G09G 3/3225* (2016.01)

(52) U.S. Cl.
CPC ..... *G09G 5/10* (2013.01); *G09G 3/3225* (2013.01); *G09G 2320/0247* (2013.01); *G09G 2320/0626* (2013.01); *G09G 2360/141* (2013.01); *G09G 2360/145* (2013.01)

(58) Field of Classification Search
None
See application file for complete search history.

(56) References Cited

U.S. PATENT DOCUMENTS

2008/0284794 A1* 11/2008 Wang ..... G09G 3/3648 345/618
2015/0287350 A1* 10/2015 Jun ..... G09G 3/006 345/690
2016/0171939 A1* 6/2016 Na ..... G09G 3/3607 345/88
2018/0047368 A1* 2/2018 Luo ..... G09G 3/20
2020/0005693 A1* 1/2020 Furihata ..... G09G 3/006
2020/0027424 A1* 1/2020 Yoo ..... G09G 5/10
2020/0143726 A1* 5/2020 Lv ..... G09G 3/16
2020/0211429 A1* 7/2020 Kim ..... G09G 3/006
2020/0211502 A1* 7/2020 Kim ..... G09G 3/006
2020/0279519 A1* 9/2020 Orio ..... G09G 3/006
2021/0049966 A1* 2/2021 Hsu ..... G09G 3/3258
2021/0311361 A1* 10/2021 Okamoto ..... G09G 5/10

OTHER PUBLICATIONS

Ohno, Y. et al., "Improved Matrix Method for Tristimulus Colorimetry of Displays," Proceedings of the AIC Color'97 Kyoto, May 26, 1997, Kyoto, Japan, 5 pages.

* cited by examiner

*Primary Examiner* — Kenneth Bukowski
(74) *Attorney, Agent, or Firm* — McCoy Russell LLP

(57) ABSTRACT

A method is provided for controlling display of an image on a display panel of a display device, the method comprising determining a commanded brightness level for the display panel, generating an index look-up table (LUT) and a mura LUT based on the brightness level and a relationship between pixel output and pixel value for each pixel of the display panel for each of a plurality of brightness levels, the relationship determined during a calibration phase and stored in memory of the display device, determining an index value for each pixel of the display panel based on the index LUT, determining a corrected pixel value for each pixel based on the mura LUT and the index value, and sending the corrected pixel value to that pixel within the display device.

19 Claims, 9 Drawing Sheets

METHODS AND SYSTEMS FOR CALIBRATING AND CONTROLLING A DISPLAY DEVICE

FIELD

Embodiments of the subject matter disclosed herein relate to the field of emissive digital display screens.

BACKGROUND

Over the years, digital computer monitors have increased in quality and undergone widespread changes in underlying technology. Cathode ray tube (CRT) monitors have been rapidly replaced with increasingly advanced flatscreen display technologies, such as liquid crystal display (LCD) and light-emitting diode (LED). Current advancements in technology have led to the organic LED (OLED) display rising in prominence, especially in the arena of portable devices, such as mobile phones.

Modern digital displays of all types synthesize images through a grid of pixels; each pixel contains three subpixels: red, green, and blue (RGB). Through varying the relative intensity of light in each subpixel, a huge variety of colors and brightness values may be created. In some display technologies, the brightness of each subpixel is controlled by varying a voltage across an active component. In other display technologies, such as LED and OLED, brightness is controlled by varying a current flowing through the active component.

BRIEF DESCRIPTION

Embodiments are disclosed herein for the calculation of a correction to a pixel value and a brightness level of a display panel to help reduce color artifacts resulting from non-linear behavior in an emissive display.

It should be understood that the brief description above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
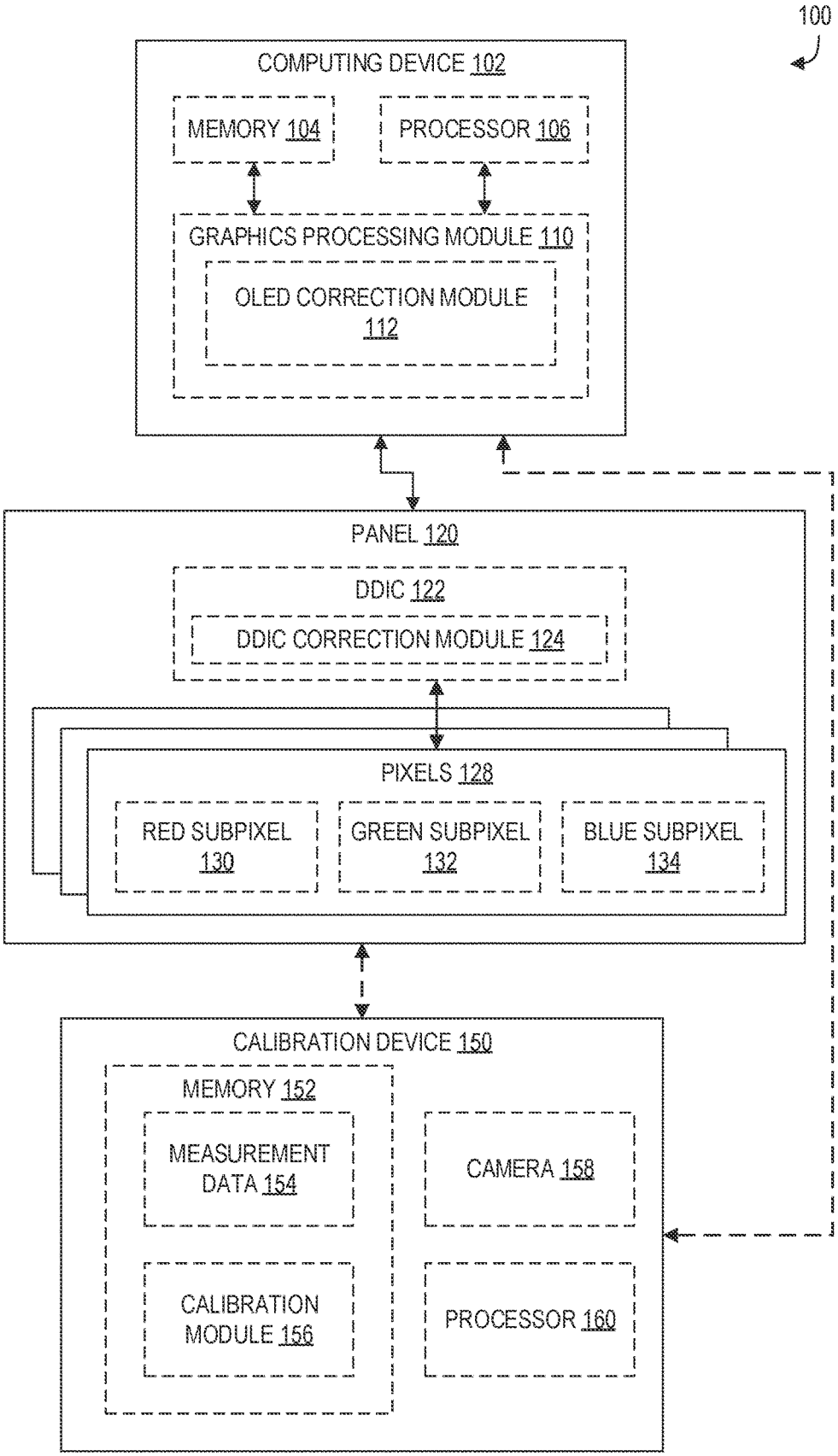
FIG. 1 shows a diagram of a computing device, a panel, and a calibration device.

The miniaturization of emissive display technology has seen an increasing prevalence over more traditional transmissive display technologies, such as liquid crystal display (LCD) technology. In particular, light-emitting diode (LED) and organic LED (OLED) technology is steadily replacing LCD technology in a variety of devices, such as televisions and mobile phones.

OLED displays continue to gain popularity because of their high brightness and almost infinite contrast ratio (e.g. the ratio between the luminescence of the brightest white producible by the display to the luminescence of the darkest black producible by the display). OLED displays obtain improved performance by being an emissive display which allows the individual pixels to be turned completely off. LCD displays, on the other hand, are transmissive displays wherein a liquid crystal is used to block the transmission of a backlight, which in practice can result in imperfect black coloration and a low contrast ratio (e.g. because the darkest possible black is still relatively bright compared to the darkest possible black of most emissive displays). The other key difference between LCDs and OLEDs is that LCDs use a voltage to set the light output (e.g. luminescence) while OLEDs use a current to set the light output. The use of a current causes the display to be more sensitive to variation within the manufacturing process. Variations in the manufacturing process affecting the current through display elements can be visibly observed through variations in gray colors in different displays, and even in different pixels within the same display. When the visible brightness and color of gray changes within the same display for the same control signals sent to a display controller, the discrepancy is known as "mura." Mura is a Japanese word meaning unevenness or a lack of uniformity Emissive color displays are created by using a device, such as a diode, in which electrons flowing through the diode transition from a higher energy state to a lower energy state. The change in energy releases a photon. The most common example of this is the LED. When the electron crosses a bandgap (i.e. the energy gap between the high and low energy states), it releases a photon with a frequency that is related to the bandgap voltage. OLEDs behave in a similar, if more complex manner. Only when the voltage across an LED is higher than the threshold does current flow and the device emits light. Once the threshold is reached, current starts to flow and the light output is approximately proportional to the current. However, the light output does not vary linearly with the voltage across the OLED, owing to the non-linear relationship between the current through the OLED and the voltage across the OLED. Therefore, OLED control circuits may be controlled to change the brightness output through direct control of the current through the OLED.

Current through the OLED may be controlled via a display driver integrated circuit (DDIC), which directly drives each of the OLEDs through programming the current flowing through each OLED. Generally, all OLEDs may be programmed in a short time frame (e.g. less than $1/60^{th}$ of a second). Current, and therefore the light output, is controlled via two parameters sent to the DDIC for an OLED display: the individual pixel output and the overall display output. The individual pixels are programmed with a current that is related to the pixel value (PV). The overall display brightness is specified by a brightness level (BL) input into the DDIC. BL adjustments input into the DDIC may be expressed by the DDIC through changing the relationship between the pixel value and the current flowing through the DDIC and/or by using a Pulse Width Modulated (PWM) waveform to turn all pixels in the panel on or off simultaneously. In some examples, the BL is related to a duty cycle of the PWM waveform, e.g. the amount of time per cycle that the PWM is outputting the desired amount of current. Ideally, changes in the BL should uniformly increase or decrease the visible brightness of all pixels on the panel, preserving the ratios of brightness between different PVs. For example, the ratio between the output of PV=16 and PV=128 should ideally stay the same regardless of the overall brightness level of the display. However, as described below, mura and color shift is a common problem with OLED displays, especially when operating at low overall brightness levels. Mura and color shift are caused by a number of non-ideal operating conditions.

To form color images through OLED (or virtually any other) display technology, each pixel within the panel may be divided into three subpixels: red, green, and blue (collectively "RGB"). The appearance of a wide range of colors may be replicated by each pixel through varying the relative intensity of each of the sub-pixels. Another source of non-ideal behavior in OLED displays is an uneven current response between the red, green, and blue subpixels; different colors of subpixels may behave differently with respect to the same current.

Thus, according to the embodiments disclosed herein, mura and/or color shift may be addressed through applying corrections to the PV input into the DDIC, such that even brightness and less severe color shift may be observed in the panel after each pixel is programmed by the DDIC. As described in further detail below, several lookup tables (LUTs) may be generated to apply corrections to the PV, depending on the BL as well.

The set of LUTs usable by a computing device may vary from panel to panel as well. Therefore, a method to calibrate lookup tables for mura and/or color shift correction is disclosed, wherein the LUT calibration is performed through performing a plurality of measurements of visible brightness emitted from the panels.

FIG. 1 shows an example diagram 100 corresponding to an interface between a computing device 102 and a panel 120, which may be an OLED display in the embodiments described herein.

Computing device 102 may comprise virtually any digital computing technology, including, but not limited to, a portable computer, a mobile phone, a color television, etc. The computing device 102 includes memory 104 and one or more processors 106. The memory 104 may include volatile (e.g. random-access memory (RAM)) and/or nonvolatile (e.g. hard disk drive (HDD)). The processor 106 may comprise one or more central processing unit(s) (CPU(s)), which are configurable to execute machine instructions stored in the memory 104. In order to generate visual output, the computing device 102 may further include a graphics processing module 110, which may be a distinct piece of hardware (e.g. a graphics processing unit (GPU)). In other examples, the graphics processing module 110 may comprise a set of instructions stored in memory 104 and executed using the computational resources of the processor 106. In some examples, the graphics processing module 110 produces output usable with panel 120 through generation of a set of pixel values output to a DDIC. In other words, the graphics processing module 110 translates data from the processor 106 into a series of pixel values usable to program the panel 120.

In order to provide corrections to the PVs generated and output to the panel 120, the graphics processing module 110 further includes an OLED correction module 112, configured to generate corrections to the raw PVs generated by the graphics processing module 110. The OLED correction module 112 may pass the desired PVs into a series of lookup tables (explained in further detail with respect to FIG. 6) depending on the BL of the panel and colors of the subpixels.

The panel 120 comprises two primary components: a DDIC 122 and a grid of pixels 128. Within each pixel are three subpixels: a red subpixel 130, a green subpixel 132, and a blue subpixel 134. Each subpixel comprises an OLED circuit, which is shown in further detail with respect to FIG. 2. As described in further detail below, the brightness for each subpixel is set via a current mirror and a capacitor, which stores the current flowing through the OLED.

Current through each OLED is driven by the DDIC 122, which programs each OLED individually by allowing current to flow through a current mirror. The DDIC 122 may program the current through each pixel (and subpixel). For example, the pixels 128 of the panel may be arranged in a rectangular grid, addressable by row and column. The row and column are addressable via two switches, one for the row and one for the column. In some examples, the DDIC may program entire rows of pixels 128 simultaneously, with the row to be programmed chosen sequentially (e.g. sequentially from an uppermost row to a lowermost row). The DDIC may also change the overall brightness of the panel 120 through the use of different BLs. Different BLs input into the DDIC may allow the DDIC to apply a PWM waveform to all pixels 128 simultaneously.

In some examples, the DDIC may further include a DDIC correction module 124, typically installed by the manufacturer of the panel 120. Manufacturers of panels, such as panel 120, may attempt corrections of their own to reduce or eliminate mura and/or color shift effects in their panels. In general, the nature of the DDIC corrections performed by the DDIC correction module 124 may not be easily knowable. Therefore, the PV correction method disclosed herein can, in some embodiments, account for PV corrections performed by the DDIC correction module.

Figure 5:
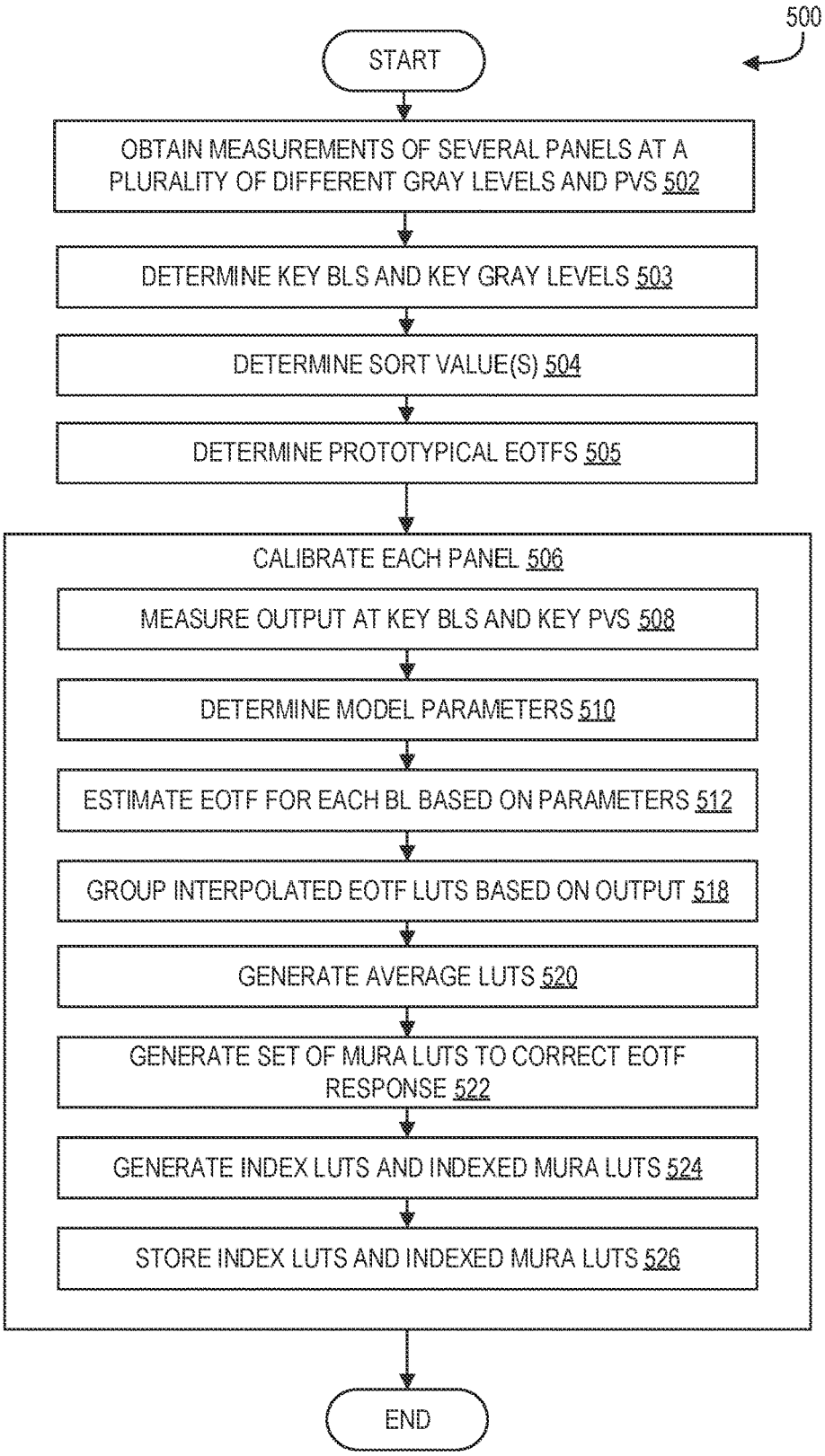
FIG. 5 shows a method to calibrate an OLED panel, according to an embodiment.

Corrections to the OLED control may be generated through a calibration process, such as method 500, explained in further detail with respect to FIG. 5. The calibration may be performed by a calibration device 150, which may be coupled to both the panel 120 and the computing device 102 during calibration. The calibration device 150 is also a computing device, equipped with additional hardware. For example, it may be a machine operating within a factory which manufactures computing devices, such as computing device 102.

The calibration device 150 includes memory 152, which may include volatile and/or nonvolatile memory. The memory 152 is usable to store measurement data 154 and a calibration module 156, where the measurement data may comprise, for example, measurements from a variety of different panels, usable to generate calibrations. In some examples, the measurement data 154 further includes a collection of prototypical EOTFs calculated from the obtained measurements, which describe the output of a family of panels. The calibration module 156 may comprise a computer program designed to use the measurement data to generate calibration data. Programs stored within the calibration module 156 may be executed using a processor 160. To obtain calibration data from each panel, calibration device 150 further includes a camera 158, which may comprise virtually any digital camera device (e.g. CCD camera) with sufficient resolution. Calibration data generated by the calibration module may comprise a set of lookup tables (LUTs), which may be transmitted to the computing device 102, for use in the OLED correction module 112.

Figure 2:
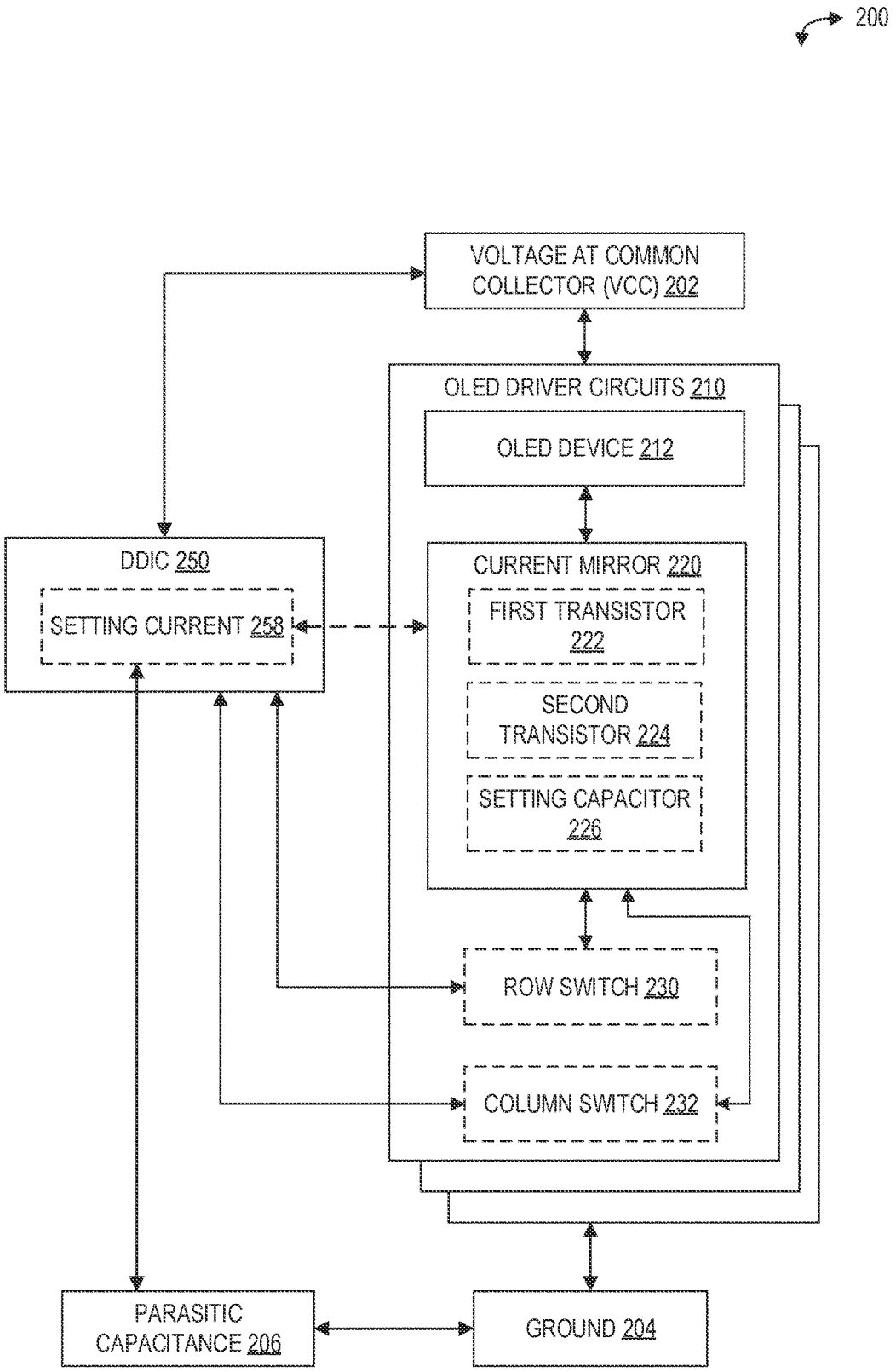
FIG. 2 shows a diagram of an example control circuit of an OLED device.

FIG. 2 shows a diagram 200 of a circuit configured to program and drive a number of OLED devices, each of which is configured to emit light in response to a current. Programming an OLED device comprises setting a current to flow through the device through a DDIC 250, with that current being sustained even after the DDIC 250 is disconnected from the OLED device. Diagram 200 includes a plurality of OLED driver circuits 210, each of which contains an OLED device 212 and a current mirror 220. The current flowing through each OLED device is specified through the DDIC 250, which is an example of the DDIC 122 within the panel. The actual current through each OLED device 212 is provided by a current mirror 220, which is explained in further detail below.

To power both the DDIC 250 and the OLED driver circuits 210, each is connected to a voltage at common collector (VCC) 202 and to a ground 204. Unless otherwise specified, as described herein, voltages will be referred to with respect to the ground 204, which will have a defined value of 0 volts. The voltage difference may be provided and sustained by, for example, a power supply connected to the panel.

To individually specify the brightness of each OLED device, each of the OLED driver circuits 210 includes a row switch 230 and a column switch 232. The row switch 230 and the column switch 232 may be opened or closed by the DDIC 250 to select which OLED device is currently being set by the DDIC. For example, if the panel contains a rectangular array of pixels arranged in 1080 rows of pixels, with each row of pixels containing 1920 pixels, the row switch may be used to select a specific row of pixels and the column switch may be used to select a specific pixel within that specific row of pixels. In some examples, the column switch 232 may be used to select a specific subpixel within the specific pixel. In some examples, the row switches may be implemented as delay lines and the column switches may be with additional digital to analog converters. When both a row switch 230 and a column switch 232 are closed, the setting current 258 is configured to flow into the current mirror 220 of the OLED driver circuit associated with that specific (sub)pixel. Otherwise (e.g. if the row switch 230 and/or the column switch 232 are opened), the setting current 258 does not flow into the current mirror 220. This occurs, for example, if the DDIC 250 is configured to program a different OLED control circuit.

The current mirror 220 within each OLED driver circuit further contains a first transistor 222, second transistor 224, and a setting capacitor 226. The first transistor 222 and the second transistor 224 may comprise metal oxide semiconductor field effect transistors (MOSFETs), or virtually any other kind of transistor technology. Continuing with the example of MOSFET transistor technology, each of the first transistor 222 and second transistor 224 may contain a source, a drain, and an emitter. In some examples, the emitter of the first transistor 222 and the emitter of the second transistor 224 may be further connected to ground 204. The setting capacitor 226 is further connected to the first transistor 222 and second transistor 224, and allows for the setting current 258 to be stored within current mirror 220 whenever both the row switch 230 and the column switch 232 are closed.

However, several non-ideal effects may arise from the configuration of the current mirror 220 and the connection between the DDIC 250 and each of the OLED driver circuits 210. Connections between the first transistor 222, the second transistor 224, the row switch 230, and the column switch 232 may introduce non-ideal effects, as parasitic capacitances may develop between the switches and the transistors. Furthermore, current flowing through the first and second transistors may vary with the pixel value non-linearly. In many examples of panels, the ground 204 is shared between each of the OLED driver circuits 210 within a row of pixels. For example, rows of pixels may be connected to different grounds, but the close proximity of these grounds to each other creates a parasitic capacitance 206, which may create a parasitic current to the ground 204, thus diverting current away from the current mirror 220. Additionally, if the row and column switches are not closed long enough, current can flow through the setting capacitor 226 also causing the wrong current to be stored.

Manufacturing differences may further contribute to non-ideal behavior in each OLED driver circuit. For example, each of the first transistor 222 and second transistor 224 may have associated threshold voltages, each of which must be met in order for the current mirror 220 to drive the OLED device 212. Below the threshold voltages, no light is emitted from the OLED device 212. Furthermore, variation of the capacitance of the setting capacitor 226 in different circuits may cause variations in the current flowing through the setting capacitor 226, leading to different current driven through the OLED device 212.

To drive each of the OLED driver circuits 210, the setting current 258 supplied by the DDIC may be given by pulse width modulation (PWM). This may comprise, for example, oscillating a setting voltage to generate the setting current, from a high value to ground. The frequency of the oscillation may be specified by a duty cycle, which, for example, may be specified as the fraction of the time that the PWM waveform is at its high point. The duty cycle of the PWM waveform may be used to turn all OLED devices on for the same period of time and off for the same period of time, and is therefore usable to specify the BL of the panel. It should be noted that, in general, there may be a temporal offset (e.g. phase delay) between the PWM waveforms driving different OLED devices. The amplitude of the PWM waveform may be individually adjusted as output is generated for each OLED driver circuit, and is therefore used in some examples to specify the PV. Further detail of different PWM cycles is shown below with respect to FIG. 3.

Figure 3:
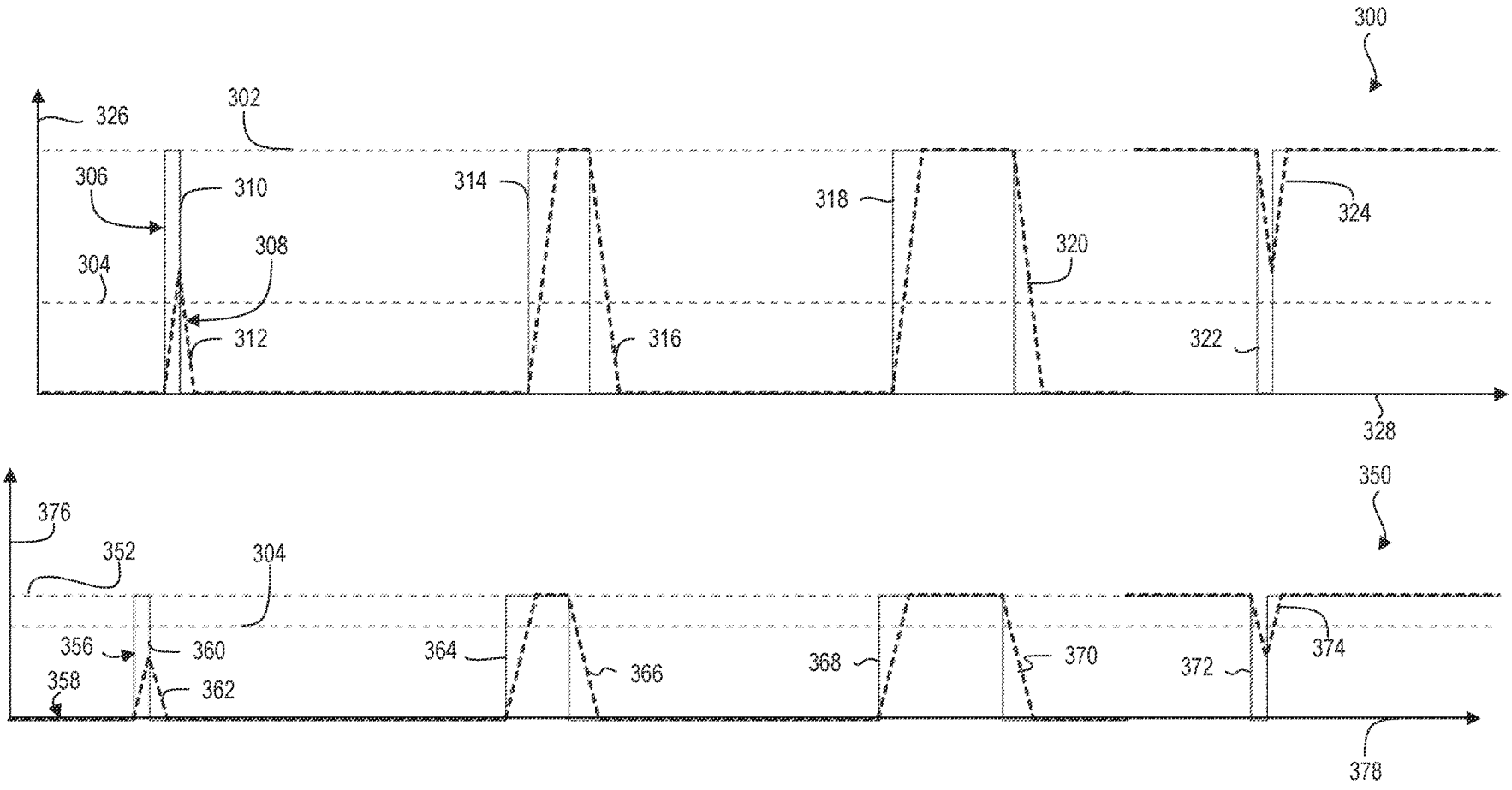
FIG. 3 shows two graphs of PWM curves.

FIG. 3 show a first PWM graph 300 and a second PWM graph 350. Both the first and second PWM graphs show examples of ideal output and actual output from a PWM driver circuit applying a voltage to an OLED driver circuits, such as one of the OLED driver circuits 210. Each show the ideal response and the actual response of an OLED element (e.g. OLED device 212) to a PWM signal. First PWM graph 300 shows the response of an OLED circuit at a first, higher PV. Second PWM graph 350 shows the response of an OLED circuit at a second, lower PV, where the maximum voltages are related to the current based on the PV desired. In the examples described below, the y-axes represent voltage across the OLED device 212.

First PWM graph 300 includes first ideal voltage 306 and first actual voltage 308 on the y-axis 326 as functions of time. The x-axis 328 represents time. The ideal voltage 306 ranges from ground (e.g. 0 V, y=0) to a first maximum voltage 302 which is dependent on the desired PV. In order for light to be emitted from the OLED device, the output voltage must reach a voltage threshold 304. After the voltage threshold 304 has been reached, brightness of the OLED element is roughly proportional to the current flowing through it, as explained above with respect to FIG. 2. The current may be approximated as roughly proportional to the voltage above the threshold. Although the relationship may not be linear, higher voltage applied across the OLED element causes a greater current to flow through it, meaning that adjusting the first maximum voltage 302 will influence the apparent brightness of the OLED element.

The first ideal voltage 306 includes a first ideal pulse 310 generated from a first, lowest duty cycle, which spikes up to first maximum voltage 302 before returning to ground. Like the other ideal pulses, first ideal pulse 310 appears substantially rectangular in first PWM graph 300. First actual pulse 312 has a more triangular shape, meaning that the first actual pulse 312 increases linearly before immediately decreasing linearly. The triangular shape of first actual pulse 312 (and the other actual pulses) is caused by the limited slew rate of the OLED driver circuit and the parasitic capacitances in the PWM driver circuit itself. However, the voltage of first actual pulse 312 is only above the voltage threshold 304 for less than half of the duration of the first ideal pulse 310. This demonstrates that at low duty cycles, parasitic capacitance can cause OLEDs to turn off for the majority of the PWM pulse duration. At very low duty cycles and pixel values (e.g. due to very low BLs), OLEDs may not turn on at all, which is explained in further detail below in second PWM graph 350.

First PWM graph 300 includes second ideal pulse 314 at a second, higher duty cycle (e.g. higher compared to the first duty cycle of first ideal pulse 310), allowing the voltage of second actual pulse 316 to reach first maximum voltage 302, plateau at maximum voltage, then linearly decrease back to ground. The time that the second actual pulse 316 spends above the threshold voltage 304 is roughly 80% of the time that the second ideal pulse 314 spends above the OLED threshold. Thus, at a longer duty cycle (e.g. higher BL), the second actual pulse 316 is above the threshold voltage 304 for a greater fraction of the duration of the ideal pulse. If the actual pulse is above the OLED threshold for longer periods of time, the display will appear brighter overall.

First PWM graph 300 includes third ideal pulse 318 with a third, higher duty cycle than both the first duty cycle and the second duty cycle of first and second ideal pulses, respectively. The effects of the longer duty cycle of third ideal pulse 318 are shown by third actual pulse 320, which remains above the OLED threshold for approximately 90% of the duration of the third ideal pulse 3, meaning that the actual PWM pulse achieves a brightness closer to the brightness of an ideal pulse at higher BLs.

First PWM graph 300 includes fourth ideal pulse 322 with a fourth, highest duty cycle (e.g. higher than the first, the second, and the third duty cycles), and may represent the ideal pulse corresponding to the highest BL. Unlike the first, second, and third ideal pulses, fourth ideal pulse 322 starts at first maximum voltage 302, then briefly drops to ground before returning to first maximum voltage 302. However, since the duty cycle of fourth ideal pulse 322 is so high, fourth actual pulse 324 does not reach a voltage below the threshold voltage 304, meaning that the OLED element will periodically dim at roughly the rate of the fourth duty cycle, but not turn completely off, since the fourth actual pulse 324 is above threshold voltage 304 for 100% of the duration of the fourth ideal pulse 322.

Second PWM graph 350 features second ideal voltage 356 and second actual voltage 358 with four pulses with the same four duty cycles as the first PWM graph 300, e.g. the same four BLs. Second PWM graph 350 features a second maximum voltage 352, which is lower than first maximum voltage 302. Therefore, second maximum voltage 352 may represent a lower PV than the first maximum voltage 302. Like first PWM graph 300, second PWM graph 350 plots the voltage (ideal and actual) on the y-axis 376 versus time on the x-axis 378.

Second ideal voltage 356 features first ideal pulse 360 at the first duty cycle. However, the low duty cycle of first ideal pulse 360 and the limited slew rate of the OLED circuit causes first actual pulse 362 to rise and fall without reaching the threshold voltage 304, meaning that no light will be emitted from the OLED element. This shows that at a lower PV, small BLs may not even produce any emitted light.

Second ideal voltage 356 features second ideal pulse 364 operating at the second duty cycle. The second actual pulse 366 is only above the threshold 304 for approximately 60% of the duration of the second ideal pulse 364, which is less than the duration spent by the second actual pulse 316 of the first actual voltage 308. Similarly, the third ideal pulse 368 operating at the third duty cycle only has a voltage above voltage threshold 304 for approximately 80% of the duration of third ideal pulse 368 (compared to 90% in the third actual pulse 320 of first actual pulse 312).

Second ideal voltage 356 features fourth ideal pulse 372 operating at the fourth duty cycle. In this case, the fourth actual pulse 374 is only above the voltage threshold 304 for approximately 50% of the duration of the fourth ideal pulse 372, meaning that the OLEDs begin flickering on and off for low PVs, even at high BLs. This means that, especially for low PVs, the overall brightness for the panel does not vary linearly with the BL.

The minimum BL required for the OLEDs to turn on at all is known as the brightness level threshold (BLT), and is empirically found to behave according to an equation of the form $$\mathrm{BLT}(\mathrm{PV})=a(\mathrm{PV})^{-b},$$

where the two fit parameters a and b may, in general, depend on properties of a given pixel, such as its location and parasitic capacitances. In practice, however, the value of b tends to remain constant throughout the panel, meaning that only the value of a tends to change from pixel to pixel. Characterization of the BLT as a function of the PV, e.g. as described in the equation above, allows for characterization of pixel output as a function of PV and BL, e.g. the EOTF as a function of the PV and the BL, which is usable to generate corrected values of the PV according to a desired brightness of the panel.

Figure 4:
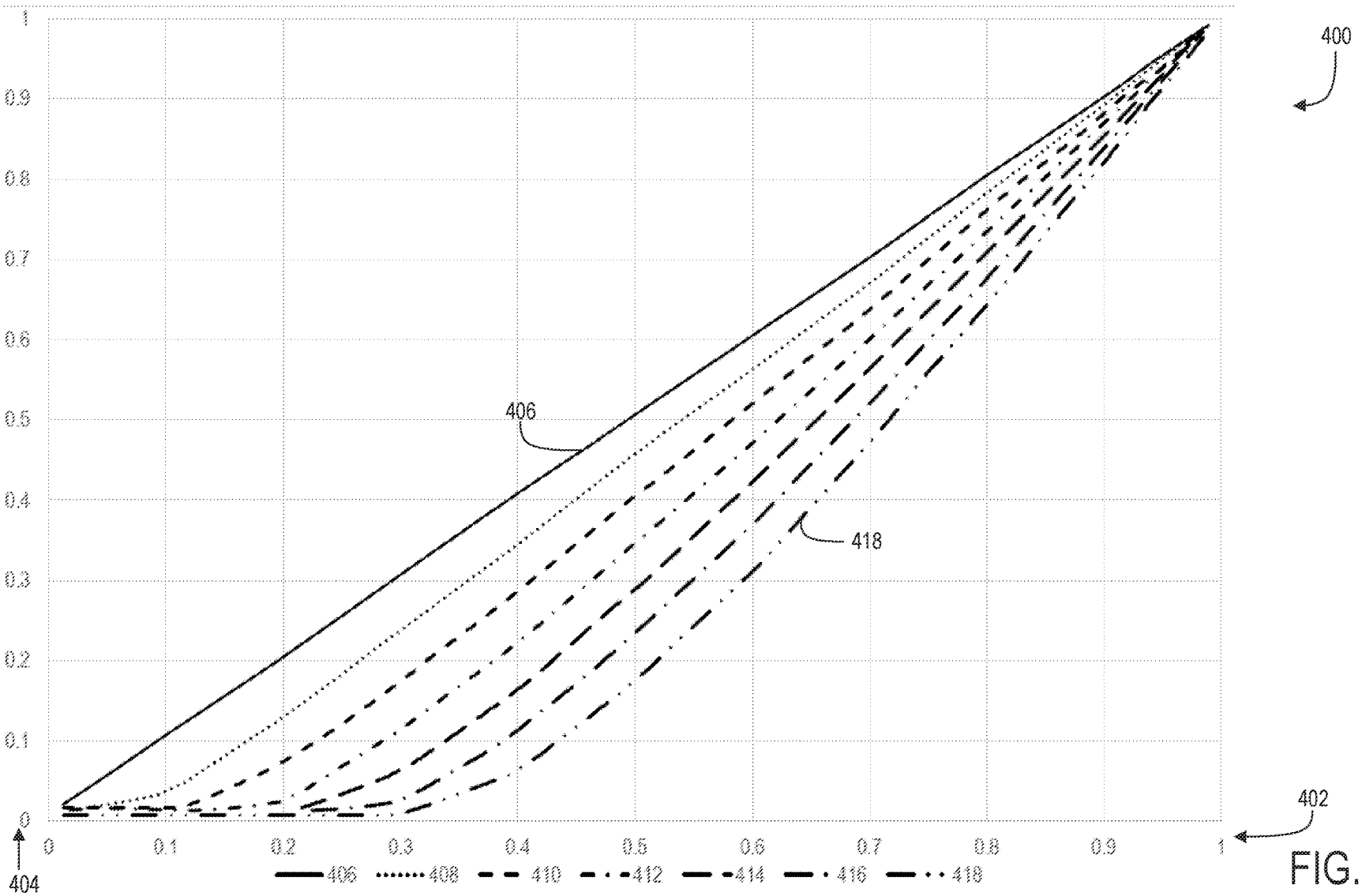
FIG. 4 shows a graph with two responses of an OLED panel.

FIG. 4 shows a graph 400 which shows example theoretical brightness levels as a function of the commanded BL for seven different commanded PVs. The seven response curves of the graph 400 are theoretical examples of measurements which may be obtained from the same OLED driver circuit, e.g. the OLED driver circuit for a single subpixel. In graph 400, the theoretical output brightness is shown on the y-axis 404, which is normalized for each pixel value such that the greatest output brightness is 1 and the lowest measured brightness is 0 for each pixel value. For example, for a pixel value of 255, the greatest output brightness for that pixel value may be the maximum brightness the pixel is capable of producing, while for a pixel value of 128, the greatest output brightness for that pixel value may be half the maximum brightness the pixel is capable of producing and half the greatest output brightness of the pixel when commanded to the pixel value of 255. The x-axis 402 shows a normalized commanded BL, with the maximum BL (e.g. the maximum BL possible to output) as 1. The graph 400 includes a first curve 406 (e.g. PV=255), a second curve 408 (e.g. PV=100), a third curve 410 (e.g. PV=50), a fourth curve 412 (e.g. PV=33, a fifth curve 414 (e.g. PV=25), a sixth curve 416 (e.g. PV=20), and a seventh curve 418 (e.g. PV=17).

Within a given OLED driver circuit, variations in parasitic capacitance and/or threshold voltages for transistors lead to different dependencies of the measured brightness value (e.g. response) compared to different commanded PVs. The first curve 406 shows a substantially linear (ideal) dependence of measured brightness on the BL. Each of the other curves (e.g. the second curve 408 through the seventh curve 418) sequentially (e.g. in order of second through seventh) demonstrate increasing deviation from the ideal linear dependence of measured brightness on the BL as the PV is decreased, e.g., increasing degrees of non-linearity in the brightness response with respect to the BL. Furthermore, the response of each pixel within the panel may depend on the location of that pixel within the panel and one or more parameters of that panel (e.g. parasitic capacitance, transistor threshold variations, etc.). Thus, while FIG. 4 shows brightness response curves for different PVs of a given pixel, different pixels on the same panel may exhibit different brightness response curves, though each pixel may exhibit the same overall trend of increasing deviation from the ideal linear curve as pixel value decreases.

As discussed above with respect to FIG. 2 and FIG. 3, the impact of the parasitic capacitances is to change the ideal response of the brightness level from being linear from maximum brightness to zero brightness to one where the brightness goes to zero brightness at a non-zero brightness level and that as the pixel value decreases, the brightness goes to zero at a faster rate. Once the dependence of the BLT on the PV is resolved, e.g. according to $BLT=a(PV)^{-b}$, the overall output of a pixel located at (x,y) at the PV may be given, for example, by an equation $$\text{output}=\text{EOTF}(x,y,\text{BL},\text{PV}),$$

where EOTF is the EOTF, which depends on the PV, the BL, and the BLT (which is in turn computed from the PV). The BL may be approximated as constant in many cases, since it is constant across all pixels within the panel and may change slowly relative to changes in the PV. Holding the BL constant yields an EOTF for a given BL, denoted $EOTF_{BL}$, which still depends on the PV:

$$\text{output}=\text{EOTFM}_{BL}(x,y,\text{PV}).$$

Throughout the present disclosure, subscripted values, such as BL above, indicate values which are held constant. The EOTF at a given BL is the actual EOTF of the panel for a fixed BL, e.g. the actual output of the panel for a commanded PV at the fixed BL. This function may behave non-linearly, especially for low BLs and low PVs. However, the function $EOTF_{BL}$ may be corrected to match a standard EOTF, denoted $EOTFS_{BL}$ which may behave more linearly with respect to the commanded PV. The standard EOTF does not depend on pixel location, since it prescribes an even output, which should not change with respect to the location of a pixel. To perform the correction, a corrected pixel value, denoted PV', may be found such that $$\text{EOTF}_{BL}(x,y,\text{PV}')=\text{EOTFS}_{BL}(\text{PV}).$$

The corrected pixel value PV' may therefore be commanded by the computing device, chosen such that the measured output generated using the corrected pixel value PV' matches the standard output at the desired PV. Assuming the EOTF at a given BL has a suitable inverse $EOTF_{BL,INV}$, the modified pixel value may be found by applying the inverse to both sides in the above equation, yielding $PV'(x,y,BL,PV)=EOTF_{BL,INV}(x,y,EOTF_{BL}(x,y,PV'))=EOTF_{BL,INV}(x,y,EOTFS_{BL}(PV))$ According to the equation above, a model of the EOTF for a given BL allows a corrected pixel value PV' to be computed from the desired PV. Sending a corrected pixel value PV' to each pixel within a panel allows for the panel to behave according to the standard EOTF. The corrected value PV' is also referred to as the mura value for the pixel, and is herein also denoted MURA(x,y,BL,PV).

Measurements of the brightness response each pixel at a variety of pixel values allows for the determination of the relationship between pixel output and brightness level for each pixel of the display panel for each of a plurality of pixel values. This relationship is usable to generate a corrected pixel value PV' for each (sub)pixel within the panel, which allows for a substantially more linear response of each pixel with respect to the brightness level. As explained in further detail below, the corrections may be given by a series of LUTs, which take as input the commanded PV, the location of the pixel, and the BL to produce a more linear dependence of the measured brightness on the PV. To measure the panel's response (and therefore correct it), a calibration device is configured to measure each pixel's output, generate the corrections, and transmit those corrections to a computing device connected to the given panel, as explained in further detail below.

Alternatively, the BLT at any given PV may be found by taking two measurements of the actual brightness at two different BLs. Finding the BLT according to two BLs is advantageous because measurements of the output may be made at high BLs, where the output of the pixel is roughly linear with respect to the BL. The BLT may then be computed as the x-intercept of the roughly linear output.

For example, given a first BL $BL_1$ and a second BL $BL_2$, the measured output at the first BL given by $EOTFM(BL_1, PV)$ and the measured output at the second BL is given by $EOTFM(BL_2, PV)$. In this case, the BLT for the PV is given by $$BLT(PV) = BL_2 - \frac{BL_1 - BL_2}{EOTFM(BL_1, PV) - EOTFM(BL_2, PV)} EOTFM(BL_2, PV).$$

Since the first and second outputs each depend on the PV, measurement of the BLT at two different PVs allows for the computation of a first fit parameter a and a second fit parameter b in the equation $BLT(PV)=a(PV)^{-b}$. For example, given a first PV $PV_1$ and a second PV $PV_2$, a first BLT may be calculated using $BLT(PV_1)$ and a second BLT may be calculated by $BLT(PV_2)$ (e.g. using the equation above, with two BLs for each of the first and second PV). The fit parameters may be computed by $$b = -\frac{\log(BLT(PV_1)) - \log(BLT(PV_2))}{\log(PV_1) - \log(PV_2)}; a = \frac{BLT(PV_1)}{PV_1^b}.$$

It should be noted that in the equation above, the logarithms are natural logarithms, although any other positive number may be used a base of the logarithms without changing the result of the calculations (provided that all logarithms are taken using the same base). Computation of the first and second fit parameters thus allows for computation of the BLT at all possible PVs. In general, the first and second fit parameters further depend on the location of the pixel, since each pixel may have different associated parasitic capacitances.

In practice, the value for the second fit parameter b tends to remain constant throughout the given panel. Therefore, once the second fit parameter b is determined, the value of the first fit parameter a may be determined for each location within the panel through the measurement of a single BLT, e.g. at a single PV. The BLT may be calculated for each pixel, for each PV, allowing corrections to be generated for the PVs. As will be explained in further detail below, corrections may be implemented in the form of a mura LUT, which takes as input a pixel location (e.g. x and y values representing its location), and a commanded PV. The mura LUT is therefore usable to generate the corrected pixel value PV' for each commanded PV, each BL, and each spatial location of the pixel.

Based on the OLED driver circuit described in FIG. 2, the output of an OLED element is a function of four variables: the parasitic capacitance, threshold variations (e.g. variations in the activation threshold of the first and second transistors), the PV, and the BL. The threshold variation and the parasitic capacitance have similar effects on the relationship between the PV, the BL, and the output brightness. A larger threshold means it takes more time to reach the threshold for a given capacitance and a larger capacitance means it take more time to reach a given threshold. Therefore, the parasitic capacitance and the transistor threshold can be treated as a single source of variation which impacts the actual output. The variation will vary based on the position on the panel, giving the EOTF described as a function of four variables:

$$\text{output}=\text{EOTF}(x,y,\text{BL},\text{PV}),$$

where x and y represent the column and row of the pixel, respectively. In some examples, x and y may represent the location of a pixel group, instead of the location of a single pixel. The EOTF takes as input a pixel position, a BL, and a PV, which indirectly represent properties of electrical signals. For example, the BL may represent a duty cycle of a PWM function used to drive all pixels within the panel at once and the PV may represent a current through the pixel located at (x,y) relative to the current driving all pixels. The EOTF, as described above, represents the measured light output of the pixel.

All possible values of the EOTF may be stored within a 4D LUT, so corrections performed based on the EOTF utilize the 4D LUT (e.g. one input for x, one input for y, one input for the BL, and one input for the PV). It should be noted that the LUT may not store correction values for each individual pixel, and instead may correct for groups of pixels. For instance, pixels may be grouped into 32 row groups and 64 column groups, meaning that the y-input and x-input of the LUT may take 64 and 32 distinct values, respectively. The group that each pixel (or subpixel) falls into is determined by its row and column. In some examples, which row group and which column group a given pixel falls into may be given by an LUT. If the output LUT has 32 bins for the output correction, 32 for the brightness, separate tables for the 3 color channels, then the total size of all tables is over 6 million entries. If each entry comprises one digital word (e.g. 2 bytes or 16 bits), the total size of all LUTs is over 6 million words (e.g. 12 megabytes). If each table is instead programmed for only a single BL, approximately 96 thousand words (192 kilobytes) would need to be stored, which is typically too much to transfer from a graphics processing module to an OLED correction module in a single vertical blanking interval (VBI, e.g. the time between when the last row is drawn within a frame and the time the first row is drawn on the next frame).

Given that the cause of the variation in output is similar regardless of the source (e.g. parasitic capacitance and/or threshold variation), the output is not explicitly dependent on the location itself, but on parasitic/threshold at that position, allowing the output to be rewritten as $$\text{output}=\text{MURA}(x,y,\text{BL},\text{PV})=\text{MURA}'(I(x,y),\text{PV}),$$

where the 2D LUT I(x,y) represents the dependence on the output on the parasitic capacitance and threshold variation at the location (x,y) and is known as an index LUT. In some examples, the index LUT is generated using the BLT for each spatial location, as explained in further detail below with respect to method 500. The 2D LUT MURA' represents corrected output as a function of the index LUT and is known as the indexed mura LUT. The indexed mura LUT takes as input an index value (from the index LUT), the BL, and the PV, and returns an output value that corrects the mura. Transmitting the mura correction LUT and the index LUT separately saves space within the memory of a device compared to storing a single 4D LUT, e.g. the mura LUT representing the EOTF corrections. Furthermore, an indexed mura LUT for a single BL, denoted $\text{MURA}'_{BL}$, suffices for use within a single brightness level, requiring only several thousand words to be updated during the transmission of $\text{MURA}'_{BL}$ vs. several million words updated during the transfer of MURA'. For example, a single BL indexed mura LUT $\text{MURA}'_{BL}$ usable for a single, constant BL may be transmitted quickly, and a new single BL indexed mura LUT may be sent any time the BL changes. Since BL changes are relatively slow compared to changes in the PV, the single BL indexed mura LUT $\text{MURA}_{BL}$ serves as a suitable approximation of MURA'.

In many examples of panels, the output of the panel is further affected through the use of gamma correction. Gamma correction may be performed through the use of a non-linear output proportional to a power γ of the linear output. In many examples, this correction is performed within the panel, and therefore affects measurements of the EOTF (and therefore affects the EOTF LUT). Gamma correction may be expressed in terms of the EOTF LUT as $$\text{EOTF}=\text{output}^{\gamma}\Leftrightarrow\text{output}=(\text{EOTF})^{1/\gamma}.$$

After applying corrections, the output may be expressed in terms of the mura LUT, the indexed mura LUT, and the index LUT as $$\text{output}=\text{MURA}(x,y,\text{BL},\text{PV})^{1/\gamma}=\text{MURA}'(I(x,y),\text{PV})^{1/\gamma}.$$

In most cases, $\gamma\geq1$ and γ can take non-integer values. Gamma correction may be used within a panel, for example, to improve a contrast within images displayed on the panel. Values of γ are generally constant throughout the panel, though they may be adjusted by a user during the operation of the panel (e.g. through the user commanding different values of γ). Gamma correction may be accounted for during the correction of the OLED using the equation above, which will be explained in further detail with respect to FIG. 5.

In many cases, non-ideal panel behavior may be corrected through changes implemented on the DDIC. Changes performed on the DDIC may be implemented by panel manufacturers in an attempt to correct the effects of non-linear behavior in the panel. In general, the nature of corrections performed by the DDIC may not be known and may vary across different BLs. Panel manufacturers may not disclose the nature of corrections made to the panel by the DDIC; corrections may instead be resolved through measuring output from the panel. To account for corrections performed by the DDIC, an approach is disclosed herein to perform adjustments using a number of prototypical EOTFs, which are derived from measurements of a large number of panels at different outputs.

FIG. 5 shows a flowchart illustrating a method 500 for generating LUTs usable to correct a response of OLEDs within a panel, such as panel 120 connected to a computing device, such as computing device 102. The response of the OLEDs, as described herein, is the output of pixels within a panel for a commanded PV, a value of γ, a BL, and the location of the pixel (e.g. x and y, the row and column of the pixel within a panel). Method 500 may be performed by a calibration device, such as calibration device 150. Method 500 may be stored within the memory of a calibration device, such as memory 152, for example; method 500 is an example of a calibration module 156, and may be executed through the use of one or more processors, such as processor 160. Method 500 may take as input both measurement data (e.g. measurement data 154) and data from a camera, such as camera 158. The camera is usable to measure a plurality of pixels on the panel (e.g. pixels 128 on the panel). Measurement data generated by the camera is usable to generate the EOTFs for each pixel (or group of pixels) using a theoretical model at 510. Additionally, or alternatively, the measurement data may be combined with one or more prototypical EOTFs to generate a collection of EOTFs which describe the behavior of the panel. The EOTFs are further usable to generate one or more the mura LUTs, further usable to generate a collection of index LUTs and indexed mura LUTs, which may be transmitted to the computing device and stored in, for example, an OLED correction module 112. The indexed mura LUTs and index LUTs use a smaller amount of computational resources compared to the mura LUT.

At 502, method 500 includes obtaining measurements of several panels at a plurality of different gray levels and BLs. Measurements are the responses of OLED devices within the panel. Gray levels, as used herein, are commanded PVs for which the red, green, and blue subpixels within each pixel are given the same input (for example, one gray level is represented by the case where the PVs of the red, green, and blue subpixels of all pixels within the panel are each equal to 128). To take each measurement, the BL and the PVs used for that measurement may be transmitted to a DDIC, such as the DDIC 122 of the panel. In some examples, the calibration device may be communicatively coupled to the computing device and the panel, which allows the calibration device to directly specify the inputs. These measurements may be stored within measurement data of the calibration device.

The panels used for the measurements obtained at 502 may be chosen to represent a wide range of manufacturing variation. The number of different BLs used to obtain measurements at 502 is dependent on how well interpolation predicts the response at intermediate BL levels. For the theoretical model shown in FIG. 4, only two key BL values are sufficient to generate accurate corrections. At 502, many more gray levels and BLs are measured than will be used to calibrate each panel. Measurement of a large collection of key BLs and gray levels allows for a collection of key BLs and key gray levels to be identified below at 503. For example, the collection of BLs measured at 502 may range from 0 to the maximum value (e.g. 255), and may include virtually all BLs therebetween, or a portion of BLs therebetween (e.g., 5-10 BLs). For each BL, measurements at several (e.g. greater than 20) gray levels may be made, e.g. through the use of the camera. Since the accuracy of the corrections resulting from the LUTs generated during method 500 may strongly depend on which specific gray levels are used, a large enough number gray level measurements may be obtained at 502 to accurately compute the remaining gray levels through interpolation between the measured gray levels. For each panel, measurements may also be obtained from a number of different pixels (e.g. 2 million pixels) or a number of different pixel groups (e.g. 2000 different pixel groups, obtained by averaging the responses of all pixels within a given pixel group).

If the EOTF response of pixels within a panel depends on the PV and the BL according to a known model, e.g. the model shown in graph 400 (see FIG. 4 above), very few measurements suffice to predict the EOTF response of the panel for virtually all BLs and PVs. Estimation of the (non-linear) EOTF response at a given BL involves computation of the BLT for the given PV:

$$\text{output}'(PV, BL) = \frac{\text{output}(PV, BL)}{\text{output}(PV, BL_{max})} = \frac{\max\{0, BL - BLT(PV)\} * BL_{max}}{BL_{max} - BLT(PV)},$$

where $BL_{max}$ is the maximum possible BL (e.g. 255), output (PV, BL) is the uncorrected output at the given PV and BL, and output'(PV, BL) is the corrected output at the given PV and BL. It should be noted that, in general, each of the above functions depend on x and y as well, but they have been omitted for notational clarity.

As discussed above, $BLT=a(PV)^{-b}$, where a and b generally depend on x and y. However, the dependency of b on x and y is usually negligible in practice. Moreover, the value of b is empirically found not to vary a significant amount between panels of the same family, e.g. panels manufactured to the same specifications and subject to the same DDIC corrections. Therefore, for a given BL, output(PV, BL) is only dependent on the measurement of a, with a varying from panel to panel and from location to location on the panel. The theoretical model of the output as a function of PV is $$\text{output}^{\gamma}=m(\text{BL}-\text{BLT}(\text{PV})).$$

There are two unknowns in the above equation: m and BLT(PV). Therefore, measurements of each pixel or pixel group at two different brightness levels are sufficient to estimate the BLT (and therefore the EOTF response at the given BL) if the BL is held constant. As discussed above, finding the BLT for two different PVs is sufficient to find the BLT for all possible PVs: $BLT(PV)=a(PV)^{-b}$. Furthermore, the value of b is empirically found not to significantly vary across a given panel. Therefore, the EOTF response for the panel may be determined with reasonable accuracy by only storing the value of a, or a transformed value based only a, as the index LUT values.

At 503, method 500 includes determining key BLs and key PVs. Key BLs are chosen such that interpolation between neighboring key BLs results in an accurate reconstruction of the EOTF. Key pixel values are gray levels chosen such that interpolation between the key PVs using one or more prototypical EOTFs (e.g. as determined at 505 below) results in an accurate reproduction of the measured EOTFs obtained at 502. Identification of key PVs for each key BL value allows for values between the key PVs to be interpolated within each BL. The number of key PVs to be identified may be specified beforehand and/or adjusted based on observations of the EOTF response measured in 502. The collection of key BLs is denoted BLK. The collection of key PVs for a particular key BL is denoted $PVK_{BL}$. The key BLs and key PVs determined at 503 are usable to reduce acquisition times of measurements of additional panels, since the collection of key BLs may comprise significantly fewer BLs than measured above at 502 and the collection of key PVs for each BL is smaller than the collection of gray levels measured above at 502.

Once the (non-linear) EOTF response at a few key BL (e.g. two or three BLs) and a few key PVs (e.g. two or three PVs for each key BL) are known, the time required to calibrate the panels may be dramatically reduced, since panels calibrated according to the methods described herein may be measured exclusively with inputs corresponding to the key BL and key PVs identified beforehand.

At 504, method 500 includes determining sort values. The sort values, as explained in further detail below, are PVs at which the (non-linear) EOTF response or mura LUT entries will be grouped and sorted, such that the (non-linear) EOTF response for adjacent PVs is highly correlated with the sort value PV. The high correlation between the (non-linear) EOTF response and the sort value PV allows for reliable predictions of the (non-linear) EOTF response at different PVs in the region of the sort values. For example, fourth curve 412 of FIG. 4 corresponds to a PV of 32, and in the example shown in FIG. 4, a single sort value (e.g. PV=32) may be sufficient for generation of corrections, since larger deviations from the ideal response (e.g. as in first curve 406) are the result of a larger BLT value at that PV and other pixel values will also have an increase of their BLT according to the model.

The sort value(s) may be determined empirically by plotting the measured pixel output (e.g., measured brightness) for the prototypical EOTFs (as determined at 505 and explained below) as a function of commanded PV for each gray level and selecting the PV(s) at which measured output has a large range of outputs for the prototypical EOTF which indicates a large amount of mura.

Sort values are chosen such that changes of EOTF response for different pixels (or groups of pixels) at the sort value predict the changes for the EOTF with the PV close to the sort value, and that there is a large variation in the EOTF response at the sort value. This may be determined, for example, by plotting the EOTF response (or corresponding mura LUT) for the prototypical EOTFs (determined at 505) within each of a collection of proposed BLs. The results of the key BLs and key gray values and the determined sort value(s) determined at 503 and 504, respectively, can be used to predict the measurements obtained at 502. A goodness-of-fit test (e.g. a chi-squared goodness-of-fit test) may be applied to the predicted and measured EOTF responses. The sort values may be determined based on the greatest goodness-of-fit results. For a panel obeying a known model, a single BL may suffice, with two or three key PVs chosen within that BL. Whether or not a family of panels follows a known model may be determined empirically, e.g. through examining a plot of the brightness response as a function of the PV and BL. If the panels do not follow a known model, the number of sort values may be increased to account for corrections performed through the DDIC. In other examples, including instances where the DDIC performs extensive corrections to the EOTF response, additional sort values may be used. The collection of sort values is denoted S.

At 505, method 500 includes determining one or more prototypical EOTFs. The prototypical EOTFs may be found, for example, through the use of a k-means clustering algorithm performed on the normalized measured EOTF responses obtained above at 502. The number k of prototypical EOTFs to resolve may be a fixed quantity set beforehand, e.g. 32 for each color channel and BL. The prototypical EOTFs represent a wide range of possible EOTF responses at different PVs and BLs. The k-means clustering algorithm produces a collection of prototypical EOTFs that minimize the variation within a cluster and maximize the differences between clusters. Usage of prototypical EOTFs may be used instead of an empirical or theoretical model by using the measurements at key BLs and key PVs to select which set of prototypical EOTFs are the closest and then refining the choice by interpolation. The collection of all prototypical EOTFs, which each depend on the BL and the PV, is denoted $\{EOTFP_i(PV,BL): 1 \le i \le k\}$.

The identification of the prototypical EOTFs at 505, coupled with the determination of the key BLs and key PVs at 503, allows for very few measurements of the EOTF response to suffice for the correction of panel output. Thus, the process described above with respect to 502, 503, 504, and 505 of method 500 may be performed with a subset of representative panels of the same make/model/manufacturer, in order to identify the sort value(s), key BL, key PVs, and prototypical EOTFs at which measurements of each individual panel of that make/model/manufacturer may be performed, in order to generate LUTs tailored for each panel that may be applied to correct PVs in order to ensure uniform pixel output intensity of each panel, as will be described below.

At 506, method 500 includes calibrating each panel, e.g. all manufactured panels of the same type (or obeying a similar model for the EOTF response) measured at 502. With the model of the response identified or a set of prototypical EOTFs generated, a set of LUTs may be generated to correct the output response for each of the plurality of panels calibrated at 506. The process of calibrating one panel is described herein below, and it is to be understood that a similar process is performed for each panel that is calibrated.

At 508, calibrating the panel includes measuring output of the panel at key BLs and key PVs. The key PVs used to perform the measurements are the key PVs identified for each of the key BLs, as identified at 503 and 504 above. The panel being calibrated may be operated (via its DDIC) at the key BLs and key PVs, with measurements of the panel taken (e.g., with the camera) at each key BL/key PV combination. Output of the panel may be measured for each pixel (or pixel group) within the panel. The measured data may be stored in memory, e.g. the measurement data of the memory of the calibration device. As above, BLK denotes the collection of key BLs. For each BL in BLK, the collection $PVK_{BL}$ represents the collection of key PVs associated with the key BL. The collection of measured EOTF responses for a given pixel or pixel group represented by (x,y) is denoted EOTFM, and is represented by $$\{EOTFM(x,y,BL,PV):BL \in BLK, PV \in PVK_{BL}\}.$$

As will be discussed in further detail below, the relatively small collection of measured EOTF responses suffices to predict the EOTF response of virtually all pixels on the panel, at all PVs and all BLs, with reasonable accuracy. For increased calibration accuracy, the measured EOTFs may be normalized. For example, a collection of normalized measured EOTFs {EOTFN(x,y,BL,PV):BL∈BLK,PV∈$PVK_{BL}$} may be generated such that for all key BLs and all key PVs PV∈$PVK_{BL}$, $$EOTFN(x, y, BL, PV) = \frac{EOTFM(x, y, BL, PV)}{\max_{BL} EOTFM(x, y, BL, PV)}.$$

At 510, method 500 includes determining model parameters. The model parameters may be derived from the collection of measurements obtained at 508. For example, if the BLT obeys a simple model, e.g. the response of the panel as shown in FIG. 4 and by equations above, method 500 may determine the first and second fit parameters a and b (e.g. using the equations described above). The fit parameters are usable to determine the EOTF (as a function of PV) for each pixel, for each BL below at 512.

If the panel does not follow a simple model, e.g. if corrections are being performed through the DDIC, the measurements of the panel's output at the key PV and key BLs are used along with the prototypical EOTFs of the panels to determine the EOTF for each pixel or group of pixels. Determination of model parameters therefore comprises identifying a subset of the prototypical EOTFs identified at 505. For example, a least square minimization of the key PV output measurements may be used to select one or more of the closest prototypical EOTFs to the key PVs. For example, given a collection of prototypical EOTFs {$EOTFP_i$: 1≤i≤k}, e.g. as identified above at 505 for the family of panels, finding the closest prototypical EOTFs for a given key BL comprises finding a number l (where 1≤l≤k) of distinct indices {$i_1$, $i_2$, . . . , $i_l$} such that $$\sum_{\substack{x,y \\ BL\in BLK \\ PV\in PVK_{BL}}} \left(EOTFN(x, y, PV, BL)^{1/\gamma} - EOTFP_i(PV, BL)^{1/\gamma}\right)^2$$

is minimized. The above sum is evaluated over all key BLs, all key PVs, and all spatial locations (x,y) within the panel. Finding the closest prototypical EOTFs for the sort value is performed by evaluating the above sum for all possible indices i and selecting the l indices {$i_1$, $i_2$, . . . , $i_l$} corresponding to the l smallest values of the above sum. The number l of prototypical EOTFs chosen may depend on several factors, including a desired accuracy (e.g. correlation between the commanded PV and the measured color), the extent of DDIC corrections (e.g. more extensive DDIC corrections may be suitably corrected through the use of a greater number of prototypical EOTFs), and a computational budget of the computing device being calibrated (e.g. if the computing device has a small amount of memory available to store the prototypical EOTFs and a limited processor for performing interpolation calculations, fewer prototypical EOTFs may be used in the calibration process. As explained above, the key BL and the key PVs are chosen from a large number of possible PVs and BLs such that fit between the EOTF derived from the prototypical EOTFs and the normalized EOTF is optimized.

At 512, method 500 includes estimating the EOTFs for each panel location and BL based on the parameters. In the case where the output of the panel follows a simple theoretical model, e.g. $output^{\gamma}$=m(BL−BLT(PV)), the BLT and the value of m may be computed for each location on the panel and each PV.

If the panel does not follow a simple model, the l prototypical EOTFs identified at 510 may be used to interpolate between key BLs and key PVs, such that the EOTF is estimated for each possible BL and each possible PV. For example, within a constant BL, the EOTF may be estimated as a function of the PV. In some examples, the prototypical EOTFs may be interpolated between to generate values of the EOTF between neighboring key BLs and neighboring key PVs. The process of determining model parameters and estimating the EOTF using the model parameters results in a collection of interpolated EOTFs, denoted {$EOTFI_{BL}$(x,y, PV)}.

At 518, method 500 includes grouping the set of interpolated LUTs based on the output. The process of grouping allows for a relatively small subset of the interpolated EOTFs to be used for OLED correction, compared to the collection of all possible pixel locations. A number g, where g is less than the maximum number of possible pixel locations, may be predetermined. For example, g=33. For each sort value PV, a spacing $\Delta_{out}$ may be defined using the interpolated EOTFS, the value of γ for the panel, and the value g by $$\Delta_{out} = \frac{\max_{PV} EOTFI_{BL}(x, y, PV)^{1/\gamma} - \min_{PV} EOTFI_{BL}(x, y, PV)^{1/\gamma}}{g-1}.$$

As indicated, the maximum and minimum values shown above are given by evaluating the interpolated EOTFs at each BL across all possible PVs and choosing the minimum and maximum values of the EOTF.

From the spacing $\Delta_{out}$ defined above, a collection of indexed output values, herein referred to as output groups, are given by $$output_{BL,j} = \min_{PV} EOTFI_{BL}(x,y,PV)^{\gamma} + j\Delta_{out}$$

for all values of j such that 1≤j≤g. Grouping of the interpolated EOTFs comprises finding, for all sort values BL and all PVs, the group index j such that $$(output_{BL,j} - EOTFI_{BL}(x,y,PV)^{1/\gamma})^2$$

is minimized. The collection of all PVs corresponding to a particular output $output_{BL,j}$ is denoted $group_{BL,j}$. A projection mapping P may be defined by $$P(PV)=j,$$

where, as explained above, the index j is chosen such that PV∈$group_j$.

Alternative methods of grouping are also possible, including principle component analysis, clustering, and other forms of grouping. For example, given a number g of groups, k-means clustering can be used to create g groups such that differences within each group is minimized and differences between the means of different groups is maximized.

At 520, method 500 includes generating a set of average LUTs. For example, LUTs within a given group, e.g. the groups resolved at 518, may be averaged to create a smoother response within each group of LUTs. For each group indexed by j, the average EOTF LUT, denoted $EOTFG_{BL,j}$, is defined by $$EOTFG_{BL,j}(PV) = \frac{1}{|group_j|}\left[\sum_{PV\in group_j} EOTFI_{BL}(x, y, PV)\right],$$

where $|group_j|$ is the size of $group_j$, e.g. the number of locations whose EOTFs which are closest to $output_{BL,j}$. In the event that a particular group is empty (e.g. containing no PVs), the average EOTF for the empty group may be chosen to be the next-closest non-empty group. Each group EOTF LUT is 2D, taking two inputs to represent the position of a pixel on the panel. In some examples, the indices j may be permuted such that output monotonically increases for increasing index. Permutation of the indices to create a monotonic order at the sort value allows for index LUTs to be generated that then interpolate between the grouped LUT.

At 522, method 500 includes generating a set of mura LUTs to correct the EOTF response. As described above, each LUT within the set of mura LUTs may correspond to a particular BL. As described above, for each BL, generating the corresponding mura LUT comprises finding an LUT which corrects the response of the EOTF LUT, e.g. to make the response of the pixels associated with the EOTF LUT to match a standard EOTF, denoted EOTFS. Ideally, no color distortion (e.g. mura) is present within the panel between different pixels. Therefore, in many examples, the standard EOTF does not depend on pixel location. For each BL, the mura may be corrected by imposing the following condition:

$$output^{\gamma}=EOTFS_{BL}(PV)=EOTF_{BL}(x,y,MURA_{BL}(x,y,PV)).$$

The value $MURA_{BL}(x,y,PV)$ is the mura LUT for the pixel at the location specified by (x,y) at the given PV. The mura LUT may comprise an LUT whose entries represent modified pixel values. The EOTF LUT, as found above, is usable to generate the mura LUT, since computation of all possible values of the EOTF allows for computation of an inverse EOTF, denoted $EOTF_{BL,INV}$. The inverse may not be unique, e.g. there may exist more than one possible inverse EOTF. Applying the inverse EOTF to the above equation gives the result $$MURA_{BL}(x,y,PV)=EOTF_{BL,INV}(EOTFS_{BL}(PV)).$$

The above equation also implies that the mura LUT further depends on the BL and on the position of the pixel within the panel (x,y). Therefore, the mura LUT represents the inverse of the EOTF for the given BL applied to the standard EOTF for the given BL. For example, at high BLs, the response may be relatively linear with respect to the PV. At low BLs, the response will be highly non-linear for low PV and linear for high PV. The mura LUT is a 3D LUT in general, but it may be reduced in dimension through the use of an index LUT, as explained below. Inversion of the EOTF is performed with respect to the PV while holding the values of x, y, and the BL constant.

It should be noted that the mura LUT generation process performed at 522 may be performed at any point in method 500 after measurements are obtained at 502. That is, the EOTF is usable to generate a mura LUT at any point during method 500, including at 505. Generating mura corrections at 505 would comprise finding a collection of prototypical mura LUTs, which are usable for grouping and sorting. Thus, any functions applied to the EOTF as explained above may be applied to the mura LUT because both are non-linear and monotonic. For example, the mura LUT may be estimated based on the parameters at 512 to generate a collection of interpolated mura LUTs. The interpolated mura LUTs may be used for grouping based on the output value at 518 to generate grouped mura LUTs, and the grouped mura LUTs may be used to generate average mura LUTs at 520. Each of the aforementioned steps are producing or using a non-linear function whose only assumption is that it is monotonic, as with the case of performing corrections directly using the EOTF, as explained above.

At 524, method 500 includes generating index LUTs and indexed mura LUTs. For each BL and for each sort value PVS, the index LUT is a 2D LUT which takes as input the x and y positions of pixels or subpixels within the panel, e.g. (x,y) and returns an index value $I_{BL,PVS}(x,y)$. The indexed mura LUT $MURA'_{BL,PVS}$ for a given sort value takes as input an index value and returns a mura value. For each possible BL, the number of indexed mura LUTs and the number of index LUTs is the same as the number of sort values. The index LUT is generated such that the value of the indexed mura LUT at index value $I_{BL,PVS}$ (x,y) is equal to the value of the mura LUT at (x,y) for all sort values PVS∈S. The average LUTs generated at 520 are used to generate the collection of indexed mura LUTs that are sorted from the smallest output value at each sort value PVS to the largest. The index table entry $I_{BL,PVS}(x,y)$ is represented by an integer part i and a fractional part f such that $I_{BL,PVS}(x,y)=i+f$, $0\leq f\leq 1$, i an integer. The index LUTs and indexed mura LUTs are generated such that $$MURA'_{BL,PVS}(i,PVS)<MURA_{BL}(x,y,PVS)<MURA'_{BL,PVS}(i+1,PVS) \text{ and}$$

$$MURA_{BL,PVS}(x,y,PVS)=(1-f)*MURA_{BL,PVS}(i,PVS)+f*MURA_{BL,PVS}(i+1,PVS)$$

for all BLs and for each sort value PVS.

When the PV is equal to a sort value PVS, the output of the mura LUT (which is a 3D LUT) is equal to the combination of using two mura LUTs (e.g. the mura values from two indexed mura LUTs for neighboring index values). If $MURA_{BL}(x,y,PVS)<MURA'_{BL,PVS}(0,PVS)$ then $I_{PVS}(x,y)=0$. If $MURA_{BL}(x,y,PVS)>MURA_{BL,PVS}(i_{max},PVS)$, then $I_{BL,PVS}(x,y)=i_{max}$, where $i_{max}=\max_{x,y,PVS} I_{BL,PVS}(x,y)$, e.g. $i_{max}$ is the maximum index value for the given BL.

Since changes in the BL are relatively slow compared to changes in the PV, only a single set of index LUTs and a single set of indexed mura LUTs (e.g. corresponding to a single BL) may be loaded to perform mura corrections. Loading only the index LUTs and the indexed mura LUTs for a single BL allows for the overall amount of information stored to be reduced, compared to storing a 3D mura LUT for each BL. If the BL of the computing device changes, a different set of index LUTs and a different set of indexed mura LUTs may be loaded, as explained in further detail with respect to FIG. 6 below. Each index LUT and each indexed mura LUT comprise 2D LUTs. Generation of the index LUTs essentially allows for pixels on the panel to be grouped by their EOTF response, instead of by their location on the screen, which reduces redundant information. For each BL, the collection of all index LUTs is denoted $\{I_{BL,PVS}:PVS\in S\}$ and the collection of all indexed mura LUTs is denoted $\{MURA'_{BL,PVS}:PVS\in S\}$.

At 526, method 500 includes storing the index LUTs and the indexed mura LUTs. For each BL and for each sort value, the corresponding index LUT and the corresponding indexed mura LUT may be stored within the memory of the computing device, e.g. within the OLED correction module. As will be explained in further detail with respect to FIG. 6 and FIG. 7, the index LUTs, the indexed mura LUTs, are used by the computing device to generate corrections which account for non-ideal behavior in the OLED panel, and, as explained above, the OLED correction module is usable to retrieve an index LUT and an indexed mura LUT whenever the BL changes. If the BL does not change, the index LUT and the mura LUT are not updated.

Thus, method 500 provides for calibrating a display panel of a display device. To calibrate the display panel, a plurality of key measurement operating points including one or more key pixel values at one or more key brightness values may be determined from a representative set of test display panels, as explained above with respect to 502 and 503. The set of test display panels may the same model/manufacturer as the display panel being calibrated. Once the key measurement operating points are determined, the display panel is commanded to operate at each of the plurality of key measurement operating points and a respective measurement of light output by the display panel at each of the plurality of key measurement operating points is obtained, as explained above at 508. Each measurement may be processed as explained above at 510-524 in order to populate one or more correction look-up tables (LUTs) based on each measurement of light output. For example, the measurements may be processed to generate one or more index LUTs and one or more indexed mural LUTs. The populated one or more correction LUTs are then stored in in memory of the display device, as explained at 526. In some examples, the plurality of key measurement operating points may include a relatively small number of key measurement operating points, such as ten or fewer key measurement operating points (e.g., three or fewer pixel values at three or fewer brightness levels). In some examples, the key measurement operating points may include only six or fewer key measurement operating points (e.g., two or three pixel values at one or two brightness values). The identification of the key measurement operating points by analyzing the set of test display panels may allow for fewer measurements to be taken when the individual display panel is calibrated. Because each manufactured display panel has to be calibrated, the small number of measurements may make the disclosed process technically feasible.

In some examples, each respective measurement of light output by the display panel may be obtained by measuring the light output by the display panel using a CMOS imager. To further expedite the calibration process, the CMOS imager may be automatically calibrated so that each calibrated display panel and the CMOS imager (e.g., camera) do not have to be perfectly aligned. The CMOS imager may be automatically calibrated by commanding the display panel to display a maximum brightness white image, measuring light output of the display panel with the CMOS imager while the display panel is displaying the maximum brightness white image to obtain calibration image information, and processing the calibration image information to generate an affine transform. The affine transform may then be applied to each respective measurement of light output by the display panel. Further, in some examples, after applying the affine transform, each respective measurement of light output by the display panel may be normalized using the calibration image information, and each normalized respective measurement may be averaged and downsampled to a resolution of one of the one or more correction LUTs (e.g., the index LUT). In some examples, the affine transform may be applied to each measurement and each affine-transformed measurement may be averaged and downsampled prior to the determination of the model parameters at 510 (or any of the other processes described at 510-526).

Figure 6:
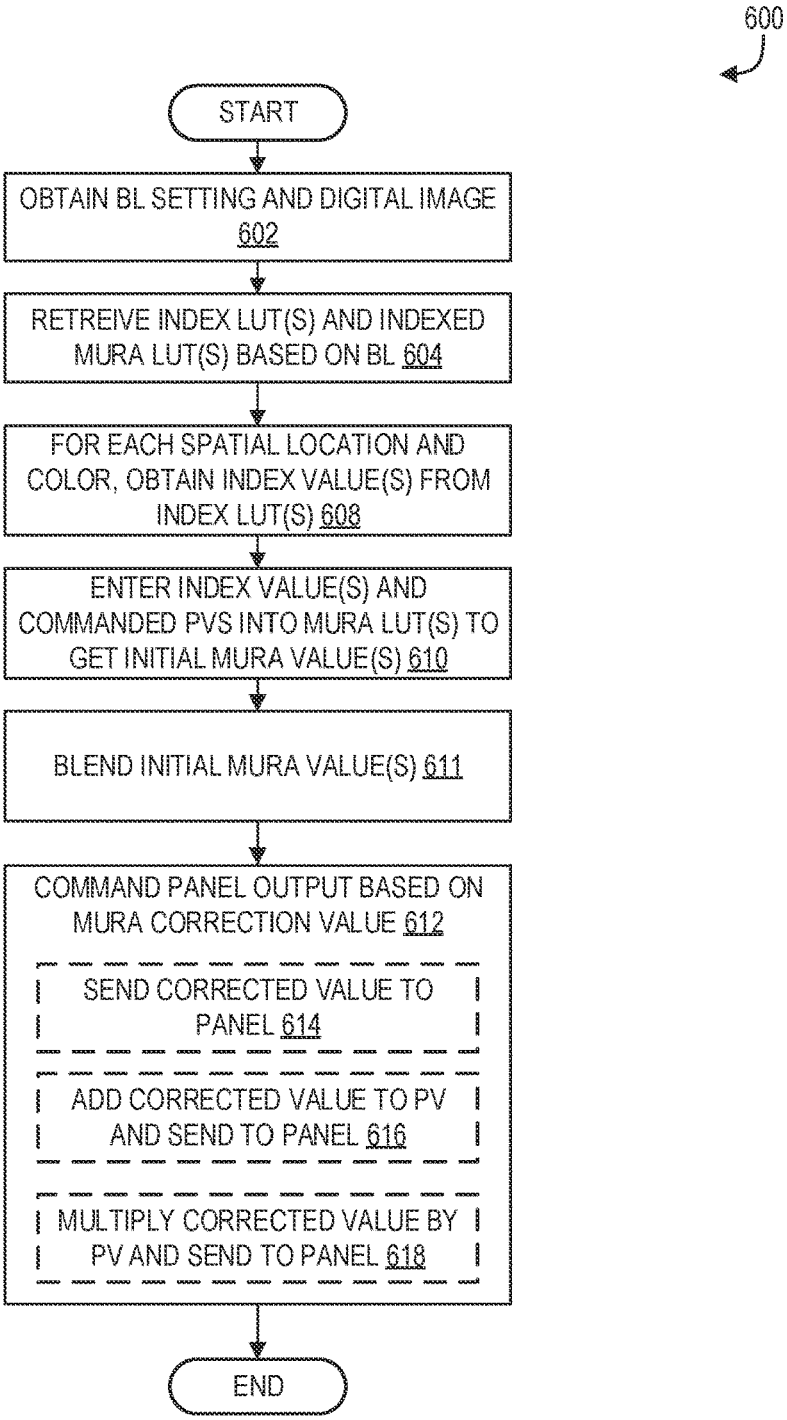
FIG. 6 shows a method to implement the OLED corrections generated during calibration in a computing device.

FIG. 6 shows a method 600 for implementing OLED corrections within a computing device, e.g. computing device 102. Method 600 may be stored within a graphics processing module, such as graphics processing module 110, and may comprise an OLED correction module, e.g. OLED correction module 112. Method 600 uses several LUTs containing calibration data, which may be generated by a calibration device, such as calibration device 150, e.g. during the execution of method 500.

At 602, method 600 includes obtaining a BL setting and a digital image. The BL setting, as described above, specifies the overall brightness of the panel. The BL may be specified, for example, through the operating system of the computing device or one or more settings within the graphics processing module. The digital image may also be sourced from the graphics processing module, and may comprise an indexed collection of commanded PVs, with each PV controlling a brightness of a particular subpixel relative to the BL. The collection of commanded PVs is indexed according to the spatial (e.g. row and column, e.g. x and y) locations of each of the pixels alongside the color of the subpixel. For example, if the panel contains 1080 rows of pixels with 1920 pixels in each row, with three subpixels within each pixel (e.g. a red subpixel, a green subpixel, and a blue subpixel), the digital image contains a total of 1920×1080×3=6,220,800 commanded PVs. In general, each commanded PV may change between frames, e.g. if the panel is used to output a video consisting of many frames (each of which comprises a digital image). BL changes may occur infrequently compared to variations in the PV.

At 604, method 600 includes retrieving index LUTs and mura LUTs based on the BL. The number of index LUTs retrieved is the same as the number of indexed mura LUTs retrieved, which is the number of sort values. The index LUTs and the mura LUTs may be retrieved, for example, from the memory of the computing device. The collection of index LUTs is denoted $\{I_{PVS}:PVS\in S\}$ and the collection of indexed mura LUTs is denoted $\{MURA'_{PVS}:PVS\in S\}$ where S, as above, is the collection of all sort values. The collections index LUTs and the indexed mura LUTs for each BL are those stored on the computing device by the calibration device at 526 above.

At 608, method 600 includes, for each spatial location and color of the digital image (thereby corresponding to each spatial location and color/subpixel of the panel), obtaining an index value from each of the index LUT(s). The index LUT(s) are those determined at 604. Each pixel within the panel is specified by a location, e.g. (i,j), which is loaded into each of the index LUTs determined at 604, e.g. loaded into the index LUTs corresponding to each of the sort values, e.g. $I_{PVS}(x,y)$. If the range of i,j is not the same as x,y, then the i,j values are scaled to the same range. After scaling, the fractional portion of $I_{PVS}(x,y)$ is used to interpolate between mura values of neighboring indexed mura LUTs, which is explained in further detail below.

As an example, with a single sort value, there is a single index LUT and a single indexed mura LUT loaded at 604. For each location (x,y), the output $I_{PVS}(x,y)$ of the index LUT is one of the inputs to the indexed mura LUT; the other input is the PV. The resulting output of the indexed mura LUT is MURA'(I(x,y),PV).

With two or more sort values, then there are as many index LUTs and indexed mura LUTs as there are sort values. Based on the PV, two of the index LUT outputs and two of the indexed mura LUT outputs are selected and blended based on how close the PV is to the two closest PVS. For example, if the collection of sort values is $S=\{PVS_1, PVS_2, PVS_3\}$, where $PVS_1=16$, $PVS_2=128$, $PVS_3=240$, the PV for a particular pixel is PV=32, the PV for the pixel is between $PVS_1$ and $PVS_2$. Therefore, an output value $I_{PVS_1}(x,y)$ from a first index table and an output $I_{PVS_2}(x,y)$ from a second index table output are input into a first indexed mura LUT $MURA'_{PVS_1}$ and a second indexed mura LUT $MURA'_{PVS_2}$, respectively, where the first indexed mura LUT corresponds to $PVS_1$ and the second indexed mura LUT corresponds to $PVS_2$. The outputs of the first and second indexed mura LUTs are given by $output_1=MURA'_{PVS_1}(I_{PVS_1}(x,y),PV)$ and $output_2=MURA'_{PVS_2}(I_{PVS_2}(x,y),PV)$, respectively. It should be noted that the same process described above may be used with any number of sort values greater than or equal to two: for all PVs between two sort values, two indexed mura outputs $output_1$ and $output_2$ may be generated.

If the PV is below the minimum sort value, only the output of the index LUT and the indexed mura LUT corresponding to the minimum sort value may be retrieved. Similarly, if the PV is above the maximum sort value, only the output of the index LUT and the indexed mura LUT corresponding to the maximum sort value may be retrieved. If the PV is equal to a sort value, only the index value and the indexed mura LUT value corresponding to the sort value are obtained. In each of these cases, two outputs are generated and set to the same value: $output_1=output_2$.

At 611, the PV and the sort values are used to blend between the two initial mura values $output_1$ and $output_2$. For example, if using linear interpolation with PV=32 and two neighboring sort values $PVS_1=16$ and $PVS_2=128$, a blend ratio r is defined by $$r = \frac{PV - PVS_1}{PVS_2 - PVS_1} = \frac{32 - 16}{128 - 16} = 0.14286.$$

For pixel values between two sort values, the a mura output is given by $$output=(1-r)*output_1+r*output_2.$$

In some examples, the fractional components of one or more index values may be used for blending. Because only two index mura LUT outputs are used at any time, the number of index mura LUTs can be reduced to two, where each table only stores the index mura LUT entries between the two sort values closest to PV. If, as mentioned above, the PV is above all sort values, below all sort values, or equal to one of the sort values, the mura correction value is sourced from a single initial output, and is not blended.

At 612, method 600 includes commanding panel output based on the mura correction value. This comprises inputting the mura correction value obtained at 610 from the mura correction LUT into a panel in order to correct for non-ideal behavior. The corrected values are sent to the panel, e.g. to the DDIC. How the corrected values are sent to the panel may, in general, depend on the implementation. Three non-limiting examples are described below.

At 614, method 600 includes sending the corrected value to the panel. In this implementation, the mura correction value is sent directly from the mura LUT to the panel. Thus, for each pixel, the index LUT and the mura correction LUT find a value which is directly input into the DDIC to control that pixel.

At 616, method 600 includes adding the corrected value to the PV and sending it to the panel. In this case, the mura correction LUT generates a value to be added to the PV before being sent. Storing the correction value as a value to be added to the commanded PV may be optimal for certain behaviors of the EOTF.

At 618, method 600 includes multiplying the corrected value by the PV and sending it to the panel. For each pixel, this comprises obtaining the mura correction value, multiplying it by the PV, and sending the resulting product to the DDIC. Storing the correction value as a value to be multiplied by the commanded PV may be optimal for certain behaviors of the EOTF.

Figure 7:
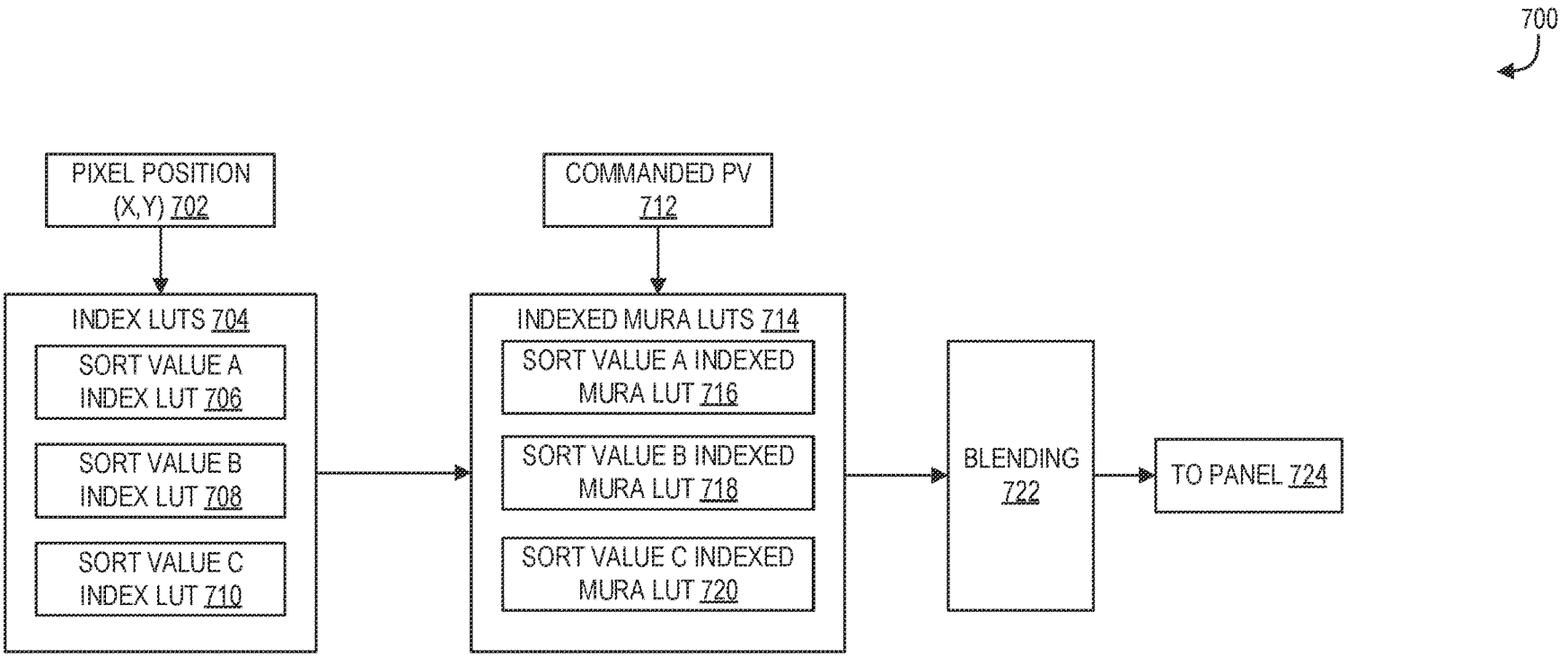
FIG. 7 shows a diagram of LUTs usable to correct OLED responses.

FIG. 7 shows a diagram 700 illustrating the inputs and outputs of the different LUTs used to correct the behavior of OLED panels and specifically correct the PV of a given pixel on the panel. The LUTs shown are examples of the LUTs described with respect to method 600 and method 500 above. Thus, the LUTs may be stored within the memory of a computing device, such as computing device 102. For example, the LUTs may be stored within an OLED correction module within the memory of the computing device.

Diagram 700 includes a pixel position 702. The pixel position may represent the row and column of the pixel to be adjusted, and may further include information about the subpixel (e.g. red, green, or blue) to be corrected as well. Diagram 700 also includes as input a commanded PV 712 which represents the desired PV for the pixel located at the pixel position 702.

The pixel position 702 may be input into one or more index LUTs 704, which include one index LUT for each sort value. The index LUTs are loaded based on a BL; whenever the BL changes, a new collection of index LUTs may be loaded. The pixel position may be a transformed value determined by the row and column index of the pixel in the panel. In the example shown in diagram 700, the index LUTs include a sort value A index LUT 706, a sort value B index LUT 708, and a sort value C index LUT 710. The index LUTs generate as output a number of index values (one for each sort value/LUT), usable to perform mura correction through the use of a collection of indexed mura LUTs. In some examples, the pixel position 702 may be loaded into only one or two of the index LUTs based on the commanded PV 712, as described above. For example, if the sort value A has a value of 16, the sort value B has a value of 128, and the sort value C has a value of 240, and the commanded PV has a value of 32, a first index value is generated from inputting the pixel position 702 into the sort value A index LUT 706 and a second index value is generated from inputting the pixel position 702 into the sort value B index LUT 708. In other cases, such as when the PV is equal to one of the sort values, the PV is below the minimum sort value, or if the PV is above the maximum sort value, only a single index value may be generated, as described above.

Diagram 700 includes indexed mura LUTs 714, which further include a sort value A indexed mura LUT 716, a sort value B indexed mura LUT 718, and a sort value C indexed mura LUT 720, e.g. one indexed mura LUT per sort value. The index values obtained from the index LUTs 704 (which may comprise, for example, one or two index values) may be input into corresponding indexed mura LUTs 714 to generate one or more initial mura values. Continuing the example above, if the PV is 32, the first index value (generated from the sort value A index LUT 706, and which may be 6649 as a non-limiting example) may be input into the sort value A indexed mura LUT 716 to generate a first initial mura value. Similarly, the second index value (generated from the sort value B index LUT 708, and which may be 199 as a non-limiting example) may be input into the sort value B indexed mura LUT 718 to generate a second initial mura value. In other examples, only a single initial mura LUT may be generated, e.g. if only a single index value is generated. In the example presented herein, the first initial mura value may be 42 and the second initial mura value may be 52.

The first initial mura value and the second initial mura value may be input into blending 722, which may compute a blending ratio, as described above, to blend the two initial mura values. The blending ratio is usable to find a linear combination of the two initial mura values, thereby generating a mura correction value. In the case that only a single initial mura value is output from the indexed mura LUTs 714, the single initial mura value is not blended with anything else, such that the single initial mura value is used as the mura correction value. The output of the blending 722 is a corrected value. The commanded PV may be normalized, generating a normalized commanded PV of 0.12549 and a blend ratio r=(0.12549−0.06275)/(0.50196−0.06275)=0.14286, using the example presented above. Using the blending ratio and the two initial mura values, a corrected value maybe calculated through a weighted average by $$(1-0.14286)\times 42+0.14286\times 52=43.4286\approx 43.$$

The mura correction value generated by blending 722 or sourced from the single initial mura value may be sent to the panel 724, as described above. Sending the mura correction value to the panel may comprise, for example, sending the mura correction value directly to the panel, multiplying the mura correction value by the commanded PV 712 before sending it to the panel, or adding the mura correction value to the commanded PV 712 before sending it to the panel. In the example presented herein, the commanded PV of 32 may be corrected to 43, which is the PV sent to the panel.

Figure 8:
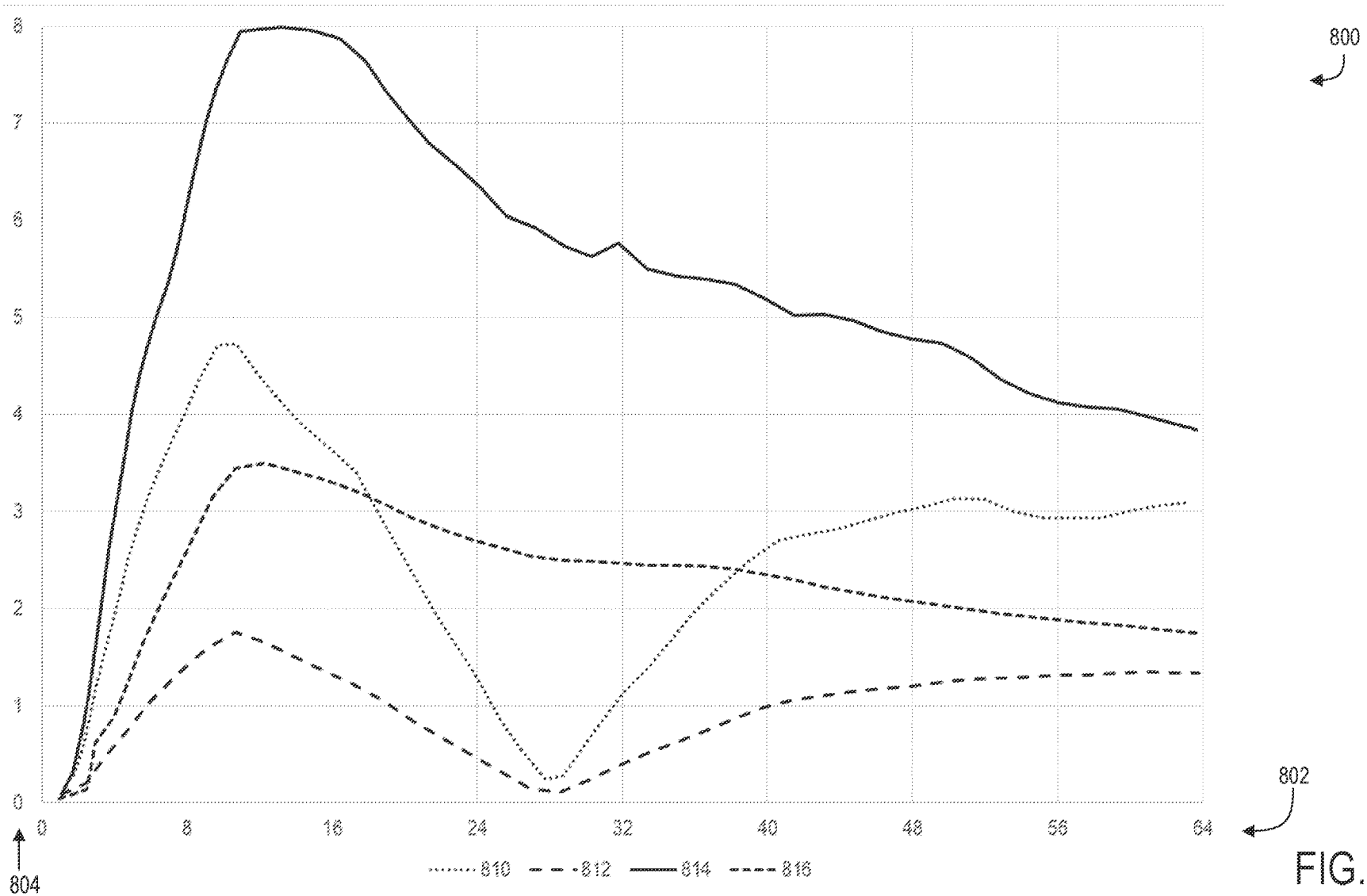
FIG. 8 shows a first graph of color differences at different pixel values for two different calibration techniques.
Figure 9:
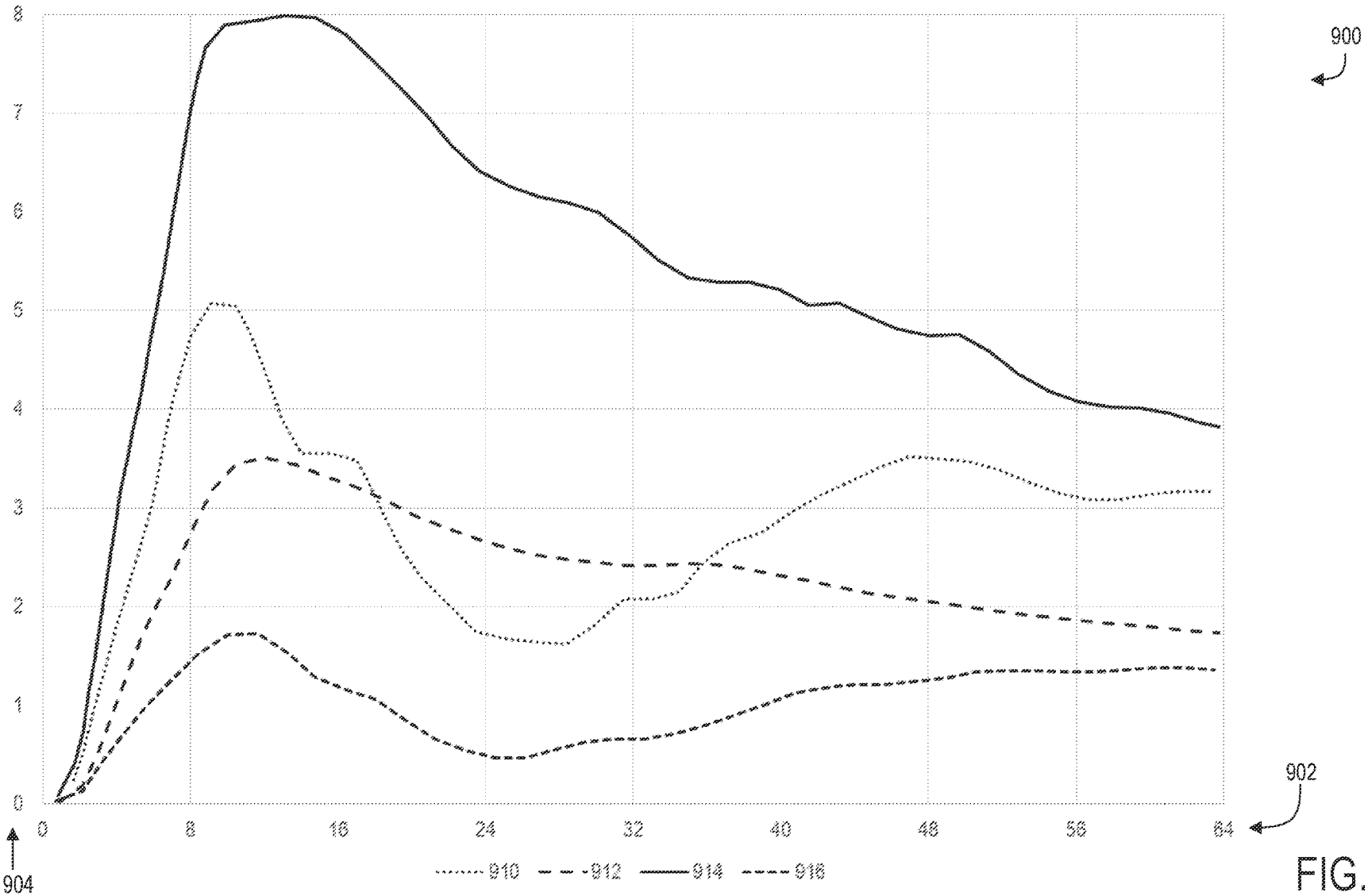
FIG. 9 shows a second graph of color differences at different pixel values for two different calibration techniques.

FIG. 8 and FIG. 9 show two graphs: a first graph 800 and a second graph 900 detailing color difference values at BL=1 for several different PVs. BL=1 was chosen because it represents a "worst case scenario," since mura distortions tend to be most visible for low BLs. For high BLs, e.g. BL=255, mura distortion tends to be less visible. Color difference, as described herein, may represent a Euclidian distance between a measured color and a commanded color; for example, if the triple ($R_M$, $G_M$, $B_M$) represents the red (R), green (G), and blue (B) components of a color (e.g. as measured through the use of a camera or colorimeter), and the triple ($R_C$, $G_C$, $B_C$) represents the commanded PVs for the red, green, and blue components of that color, the color difference may be defined as $$dE=\|(R_C,G_C,B_C)-(R_M,G_M,B_M)\|_2=\sqrt{(R_M-R_C)^2+(G_M-G_C)^2+(B_M-B_C)^2}.$$

It should be noted that various other definitions of the color difference exist, and different color space difference definitions may be used for different color space models. Color differences may be defined, for example, in terms of a hue, a saturation, and/or a contrast of the colors. The color difference formula may also try to replicate the perceptual Just Noticeable Difference (JND) that can be observed and are often normalized such that a value 1 is noticeable under ideal conditions. The color space difference is therefore a measurement of the accuracy of the color correction. Color difference equal to zero represents optimal color correction, since a color difference of zero would imply that the measured color is exactly equal to the commanded color.

The first graph 800 shows a first collection of color differences, corresponding to two calibrations methods of a panel, one conventional calibration and one calibration generated through the use of the methods disclosed herein. Calibrations performed through the methods disclosed herein and shown within the first graph 800 were performed through the use of approximately 20 different measurements at a BL. As will be explained in further detail below with respect to the second graph 900, fewer measurements suffice for adequate color calibration.

The first graph 800 includes an x-axis 802, which represents a commanded PV divided by 4. The commanded PVs of each of the red, green, and blue subpixels were set to the same value, e.g. the commanded PVs represent gray levels. Graph 800 includes a y-axis 804, which represents the JND. Four curves are shown in graph 800: first curve 810, second curve 812, third curve 814, and fourth curve 816.

First curve 810 represents a maximum value for the color difference across all pixels in a panel, where the color difference is generated through the use of the methods disclosed herein. A single sort value of PVS=112 was used to generate the first curve 810, which was created using approximately 20 measurements of a panel. The maximum color difference (where the color difference is taken for each pixel in the panel) represents the greatest deviation due to mura.

Second curve 812 represents an average value for the color difference across all pixels in a panel, where the color difference is generated through the use of the methods disclosed herein. A single sort value of PVS=112 was used to generate the second curve 812, which was created using approximately 20 measurements of a panel. The average color difference (where the color difference is taken for each pixel in the panel) represents the average deviation due to mura.

Third curve 814 shows the maximum value for the color difference across all pixels in a panel, where the panel was calibrated using the average of all the mura LUTs generated for the panel. This can create data that is compatible hardware that is already included in most graphics processing modules (e.g., OLED correction module 112) and is referred to as low brightness color calibration, or LBCC. Note that the color difference in the third curve 814 is greater than or equal to the color difference of the first curve 810 or second curve 812 for virtually all PVs, meaning that the methods disclosed herein were used to create a smaller color difference, and therefore a more accurate calibration for the panel. The difference is better represented using the average color difference for the LBCC, shown by fourth curve 816.

The second graph 900 shows a first collection of color differences, corresponding to two calibrations methods of a panel, one conventional calibration and one calibration generated through the use of the methods disclosed herein. Calibrations performed through the methods disclosed herein and shown within the second graph 900 were performed through the use of approximately 5 different measurements at key PVs.

The second graph 900 includes an x-axis 902, which represents a commanded PV divided by 4. The commanded PVs of each of the red, green, and blue subpixels were set to the same value, e.g. the commanded PVs represent gray levels. Second graph 900 includes a y-axis 904, which represents the JND. Four curves are shown in second graph 900: first curve 910, second curve 912, third curve 914, and fourth curve 916.

First curve 910 represents a maximum value for the color difference across all pixels in a panel, where the color difference is generated through the use of the methods disclosed herein. A single sort value of PVS=112 was used to generate the first curve 910, which was created using 5 measurements of a panel. The maximum color difference (where the color difference is taken for each pixel in the panel) represents the greatest deviation due to mura.

Fourth curve 916 represents an average value for the color difference across all pixels in a panel, where the color difference is generated through the use of the methods disclosed herein. A single sort value of PVS=112 was used to generate the fourth curve 816, which was created using 5 measurements of a panel. The average color difference (where the color difference is taken for each pixel in the panel) represents the average deviation due to mura.

Third curve 914 shows the maximum value for the color difference across all pixels in a panel, where the panel was calibrated through LBCC. Note that the color difference in the third curve 914 is greater than or equal to the color difference of the first curve 910 and second curve 912 is greater than or equal to the fourth curve 916 for virtually all PVs, meaning that the methods disclosed herein were used to create a smaller color difference, and therefore a more accurate calibration for the panel. The difference is better represented using the average color difference for the LBCC, shown by third curve 914.

Common trends can be observed between both the LBCC calibration and the calibration according to the methods disclosed herein, using either 20 measurements (as in the first graph 800) or using 5 measurements (as in the second graph 900). For example, each curve in both the first graph 800 and the second graph 900 attains its highest value of dE between PV=32 and PV=64. This is because, at low PVs, a parasitic capacitance within the panel causes a significant amount of current to be diverted away from a current mirror, causing an inaccurate color to be displayed. After that point, each curve drops off (at different rates), showing that commanded PVs result in measured outputs that are more consistent across the panel. Similar JND and consistent overall trends observed between the first curve 810, second curve 812, first curve 910, and fourth curve 916 show that relatively few measurements of a panel suffice for generating mura correction LUTs usable to correct colors within the screen. Although more measurements (as in the first graph 800) produce slightly more accurate results, fewer measurements (as in the second graph 900) decrease the amount of time used to perform calibrations. In either case, the results are generally more accurate than calibration according to LBCC, and may be performed using less time. Performance may be further improved by increasing the number of sort values and/or choosing sort values optimally.

Thus, mura may be corrected by calibrating each individual panel as described above. The mura correction is determined for each pixel or group of pixels of each individual panel. In some examples, the group of pixels is set to be all the pixels in the display panel, or a central region of the display. In such examples, only one mura LUT for each color is determined from the measurements and only the low brightness color shift is being corrected. That is, there is no longer an index LUT and the same correction is applied regardless of the position of the pixel in the panel. The one region might be found by averaging measurements made using an imaging sensor or can be found by using a colorimeter or spectrometer.

Performing the measurements described herein for mura correction in a high volume manufacturing environment can be challenging. The current state-of-the-art calibration for panels only corrects the response for a single brightness level and does not correct for non-uniformity. Even performing this level of correction takes a little under 30 seconds and requires several test stations to be operated in parallel. Just the measurement time for a single low brightness and low gray level can take several seconds, and thus doing multiple measurements would end up taking significantly longer than current methods and require even more test stations operating in parallel. However, by generating the EOTF for a pixel location by using only a few measurements and the prototypical EOTFs it is possible to measure at higher pixel values such that the longest measurement is less than 1 sec and typically 100 msec or less. If the measurements and readout take 0.5 sec, then 60 measurements can be made in the time that previous state-of-the-art calibrations were performed (e.g., 30 seconds). With approximately 5 measurements per backlight level (e.g., brightness level), 12 different backlight levels (e.g., brightness levels) can be measured.

Being able to automatically calibrate the camera is also desirable. The goal for demura is for all the backlight levels and gray levels to be the same color temperature and have the same uniformity as white at maximum brightness. Because of this, only the measurement made for white at maximum brightness along with three additional measurements of maximum amplitude red, green, and blue may be performed to do the calibrations.

The white field is used to automatically find the corners of the display, eliminating the need for perfect alignment. The four corners are found by finding two points along each side of the display while ignoring notches and camera holes and then finding the intersection of the four lines described by each pair of points to determine the corner. Using the four corners found on the display, an affine transform is then created to map the display to a rectangle that is proportional to the dimensions of the index LUT. This result is then downsampled, using averaging to improve the SNR, to the dimensions of the index LUT. The same affine transform and downsampling is applied to all the other images during calibration.

To find the points along the edge of the display, it is assumed that the panel is somewhat centered in the image. Starting from on offset towards the top and bottom of the display, the average value of the image at each point may be determined to create a threshold and then while moving towards the left and right edges of the display, the threshold may be based on the previous threshold and value of the image at this point. This compensates for vignette in the raw image. When the input is less than the threshold and the pixel closer to the center was higher than the threshold, that indicates the edge of the display. From the two points found on each edge, the slope and offset for the line may be identified. The offset may be changed to move closer to the interior of the display to avoid rounded corners or camera holes and move along those two lines to find the top and bottom edges. From the line describing the bottom edge, while moving towards the interior, the left and right edges may be identified again to get a more accurate line for the left and right edges. Then the intersect of the four lines describing the edges may be identified to get the four points.

Using the center region of the downsampled version, the average values for the white, red, green, and blue test patterns may be obtained. This allows a color calibration matrix (CCMX) to be determined such that the camera output for the red test pattern only has values on the red channel, the green test pattern only has outputs on the green channel, the blue test pattern only has outputs on the blue channel, and the white test pattern has equal values for the red, green, and blue channels. The CCMX is used during the processing of all other images. The method used is the same method used to calibrate colorimeters for a particular display, but using RGB instead of XYZ in the algorithm If absolute calibration is desired, a colorimeter or spectrometer can be used on the same test patterns to determine the chromaticity of the panel which can be used to modify the CCMX.

The lens for the camera/sensor may operate with a large aperture to capture as much light as possible. For the working distances involved for calibration, there is likely to be significant vignette in the image. The vignette can be captured beforehand by using an evenly illuminated target, or it can be corrected for in the calibration process. Because the uniformity of white at maximum brightness is considered acceptable, this can be used as the reference for uniformity. Therefore, all images captured can be normalized by dividing them by the output of this capture. This corrects both the vignette of the capture and the white balance because it insures that for white, the normalized output has red=green=blue=1.

To speed up the measurements, it is desirable to use a color CMOS sensor. These sensors use a bayer pattern of RGB to capture the color image. The panel also has a spatial arrangement of the RGB colors. To accurately capture the color, the 2×2 bayer pattern in the camera would need to be significantly smaller than the smallest OLED sub pixel. The smallest sub pixel can be less than ½ the dimension of what is consider a pixel. In the pentile layout, the spacing of the green sub pixel is considered the resolution of the panel.

With panel resolutions of high end mobile devices being around 1440×3200, to capture the image would require the use of a mono sensor with a resolution of greater than 2880×6400, to use a color sensor would require twice that resolution in both directions, 5760×12800. Most sensors have a 4:3 ratio so that would mean a color sensor of 9600×12800 or 123 Mpix which is not currently feasible. Therefore, the desired approach is to slightly defocus the camera so that the panel appears to be solid red (the largest gap between sub pixel spacing for a pentile arrangement) when red is displayed. This can be easily verified using the red test pattern capture.

In addition, defocusing the camera can reduce the impact of dust on the panel during measurements. If the white captured image is used as the reference to correct for vignette, then that same correction will also correct for dust spots as long as the dust does not completely obscure the light reaching the camera sensor.

Thus, display panels used in mobile devices, tablets, laptops, or other display devices may be calibrated following the approaches described herein. The approaches may include a simple model approach when the panel manufacturer is not applying their own corrections, or a prototypical EOTF approach when the manufacturer is applying their own corrections (that are not known during calibration). For the simple model approach, a set of panels from the manufacturer that represent a range of possible responses may be obtained and the panels may be controlled to output light at several gray levels and several brightness levels, with measurements taken at each gray level/brightness level combination. From these measurements, the gray levels (e.g., pixel values) and brightness levels that result in the most accurate parameters for the model may be identified. Then, for each panel that is calibrated, the panel is measured at the key pixel values and brightness levels and the parameters of the model are determined based on those measurements for each pixel. The EOTF is determined for each pixel based on the parameters of the model. Optionally, the turn-on threshold (e.g., brightness level threshold) may be estimated from the parameters and the response for pixel values at a given brightness level may be estimated from the turn-on threshold. The LUT that corrects the mura (for each pixel) may be generated based on the estimated EOTF.

The LUTs generated as described above may be grouped based on the LUT output value at one or more input pixel values. Further, an average LUT may be generated based on the grouped LUTs and arranged in a monotonic order to create a 2D LUT at one or more pixel values (sort value). If more than one sort value is identified, then two or more sets of 2D LUTs are generated. These LUTs are the mura LUTs. Because an average is used, the response of the first and last LUT may be adjusted so that only interpolation is required and not extrapolation in the following steps (note, that in general, where interpolation is used, extrapolation could also be used).

An index value for each spatial location on the panel is generated such that the interpolation between one or more of the LUTs results in the output of the 2D LUT at the sort value to be equal to the LUT that was generated based on the estimated EOTF for that spatial location of the panel. This collection of index values is the index LUT.

The prototypical approach may be similar, but may use more/different measurements. The representative panels may be measured at several gray levels and several brightness levels, similar to the simple model approach. The measurements may be normalized so that white (maximum output) is equal to one for each brightness level. For each BL, the average for several groups of EOTFs for each brightness level and color channel are identified.

Then, for each panel that is calibrated, a few key pixel values and BL levels are measured. These measurements are normalized so that white for each group (one or more) of pixels is equal to one. The EOTF for each group (one or more) of pixels is estimated using those measurements and the LUT that corrects the EOTF is found. Alternatively, a non-linear version of the EOTF can be identified. The rest of the process is the same as described for the simple model approach (e.g., grouping the LUTs, generating the index LUT).

Once a panel is calibrated and during use of the panel, commanded pixel values may be adjusted using the mura LUTs/index LUT generated for that panel. For a brightness level setting, the values for the index and mura LUT are calculated from a set of index and mura LUTs, using interpolation if the actual brightness level setting does not have a set of LUTs. The calculated values are loaded into the index and mura LUT. If the data is stored and calculated off chip, then the data is transmitted and loaded.

For each spatial location and color channel of an image to be displayed, the value in the index LUT is obtained, using interpolation if the size of the index LUT is smaller than the panel resolution. Using the value from the index LUT and the pixel value, the value in the mura LUT is obtained, using interpolation if required. The value from the mura LUT is output to the panel, and/or the mura LUT may store a delta to add to the input pixel value or a gain to multiply the input pixel value by.

The measurements performed at the gray levels and brightness levels may be obtained using a commercial CMOS imager, e.g., an imager designed for astronomical captures, which supports linear RGB measurements. A thermoelectric cooler may be used to provide a stable operating temperature and lower noise. The camera (e.g., CMOS imager) may be defocused slightly to eliminate moire between the RGB filter in the camera and the RGB sub pixel layout of the panel.

For each panel (or at least once for a given panel model), in addition to the measurements used for characterizing the panel, white, red, green, and blue (WRGB) full field images may be captured. The WRGB images may be used to determine a correction matrix to eliminate crosstalk between the RGB output of the panel and the RGB filters of the imager. That is, when the panel displays red, the processed camera output has only red; when green, only green is output; when blue, only blue is output; and when white, the red, green and blue outputs are equal.

The maximum brightness level white image may be processed to find an affine transform so that alignment with the camera does not have to be perfect. For all the captures, this affine transform may be applied. The result may be normalized using the max brightness white image and averaged and downsampled to the resolution of the index LUT.

The technical effect of generating mura correction LUTs and index LUTs based on the output brightness of the OLED elements in the panel is to cause the output brightness of the panel to behave more linearly with respect to PV and pixel location. This reduces unevenness in the color and brightness of each element of the panel, and makes each computing device calibrated with the panel more uniform. The effects are particularly visible for shades of gray at low brightness, where color distortions are minimized.

The disclosure also provides support for a method for controlling display of an image on a display panel of a display device, the method comprising: determining a commanded brightness level for the display panel, generating an index look-up table (LUT) and a mura LUT based on the brightness level and a relationship between pixel output and pixel value for each pixel of the display panel for each of a plurality of brightness levels, the relationship determined during a calibration phase and stored in memory of the display device, determining an index value for each pixel of the display panel based on the index LUT, determining a mura value for each pixel of the display panel based on the corresponding index value for that pixel, a pixel value for that pixel, and the mura LUT, where the pixel value for that pixel is determined based on the image, and sending a corrected pixel value for each pixel to the display panel. In a first example of the method, the corrected pixel value is an output value of the mura LUT. In a second example of the method, optionally including the first example, the corrected pixel value comprises the pixel value corrected by an output value of the mura LUT. In a third example of the method, optionally including one or both of the first and second examples, determining an index value for each pixel of the display panel based on the index LUT comprises entering each spatial location of the image into the index LUT, and wherein the index LUT is configured to output a corresponding index value for each spatial location. In a fourth example of the method, optionally including one or more or each of the first through third examples, the method further comprises: for each pixel that does not directly correspond to a respective spatial location of the index LUT, performing an interpolation of two or more index values from the index LUT. In a fifth example of the method, optionally including one or more or each of the first through fourth examples, determining a mura value for each pixel of the display panel based on the corresponding index value for that pixel, a pixel value for that pixel, and the mura LUT comprises entering the corresponding index value for each pixel and the pixel value for each pixel as inputs into the mura LUT, and wherein the mura LUT is configured to output a corresponding mura value for each index value and pixel value.

The disclosure also provides support for a display device, comprising: a display panel, a processor, and memory storing instructions by the processor executable to, when displaying a digital image on the display panel: determine a commanded brightness level for the display panel, generating an index look-up table (LUT) and a mura LUT based on the brightness level and a relationship between pixel output and pixel value for each pixel of the display panel for each of a plurality of brightness values, the relationship determined during a calibration phase and stored in memory of the display device, determine an index value for each pixel of the display panel based on output from an index look-up table (LUT), determine a mura value for each pixel of the display panel based on the corresponding index value for that pixel, a pixel value for that pixel, and output from a mura LUT, where the pixel value for that pixel is determined based on the digital image, where the index LUT and the mura LUT are populated based on the commanded brightness level, and send a corrected pixel value for each pixel to the display panel. In a first example of the system, the corrected pixel value is an output value of the mura LUT. In a second example of the system, optionally including the first example, the corrected pixel value comprises the pixel value corrected by an output value of the mura LUT. In a third example of the system, optionally including one or both of the first and second examples, determining an index value for each pixel of the display panel based on the index LUT comprises entering each spatial location of the image into the index LUT, and wherein the index LUT is configured to output a corresponding index value for each spatial location. In a fourth example of the system, optionally including one or more or each of the first through third examples, the system further comprises: for each pixel that does not directly correspond to a respective spatial location of the image, performing an interpolation of two or more index values from the index LUT. In a fifth example of the system, optionally including one or more or each of the first through fourth examples, determining a mura value for each pixel of the display panel based on the corresponding index value for that pixel, a pixel value for that pixel, and the mura LUT comprises entering the corresponding index value for each pixel and the pixel value for each pixel as inputs into the mura LUT, and wherein the mura LUT is configured to output a corresponding mura value for each index value and pixel value. In a sixth example of the system, optionally including one or more or each of the first through fifth examples, the relationship is determined during the calibration phase by commanding the display panel to operate at a plurality of different pixel values at each of one or more brightness values, and wherein the relationship is determined by measuring, with a camera, pixel output for each pixel or group of pixels of the display panel at each commanded pixel value. In a seventh example of the system, optionally including one or more or each of the first through sixth examples, the plurality of different pixel values comprises two or three different pixel values, and wherein the one or more brightness values comprises one, two, or three brightness levels.

The disclosure also provides support for a method for calibrating a display panel of a display device, comprising: determining, from a representative set of test display panels, a plurality of key measurement operating points including one or more key pixel values at one or more key brightness values, commanding the display panel to operate at each of the plurality of key measurement operating points, obtaining a respective measurement of light output by the display panel at each of the plurality of key measurement operating points, populating one or more correction look-up tables (LUTs) based on each measurement of light output, and storing the populated one or more correction LUTs in memory of the display device. In a first example of the method, the plurality of key measurement operating points includes only six or fewer key measurement operating points. In a second example of the method, optionally including the first example, obtaining each respective measurement of light output by the display panel comprises measuring the light output by the display panel using a CMOS imager. In a third example of the method, optionally including one or both of the first and second examples, the method further comprises: automatically calibrating the CMOS imager by commanding the display panel to display a maximum brightness white image, measuring light output of the display panel with the CMOS imager while the display panel is displaying the maximum brightness white image to obtain calibration image information, and processing the calibration image information to generate an affine transform. In a fourth example of the method, optionally including one or more or each of the first through third examples, the method further comprises: applying the affine transform to each respective measurement of light output by the display panel. In a fifth example of the method, optionally including one or more or each of the first through fourth examples, the method further comprises: after applying the affine transform, normalizing each respective measurement of light output by the display panel using the calibration image information, and averaging and downsampling each normalized respective measurement to a resolution of one of the one or more correction LUTs.

The disclosure also provides support for a method for controlling display of an image on a display panel of a display device, the method comprising: determining a commanded brightness level for the display panel, populating one or more index look-up tables (LUTs) and one or more mura LUTs based on the brightness level and a relationship between pixel output and brightness level for each pixel of the display panel for each of a plurality of pixel values, the relationship determined during a calibration phase and stored in memory of the display device, for each commanded color of the image and at each spatial location of the display panel, determining a primary index value from the one or more index LUTs, entering each primary index value and a corresponding pixel value into the one or more mura LUTs to obtain a mura value for each pixel of the display panel, where each pixel value is determined based on the image, and commanding output of the display panel based on each mura value. In a first example of the method, the relationship between pixel output and brightness level for each pixel of the display panel for each of the plurality of pixel values includes a first sort value and a second sort value, and wherein populating the one or more index look-up tables (LUTs) and the one or more mura LUTs comprises populating a first index LUT based on the first sort value, populating a second index LUT based on the second sort value, populating a first mura LUT based on the first sort value, and populating a second mura LUT based on the second sort value. In a second example of the method, optionally including the first example, determining the primary index value comprises obtaining a first index value from the first index LUT, obtaining a second index value from the second index LUT, and determining the primary index value based on the first index value, the second index value, the pixel value, and each of the first and second sort values. In a third example of the method, optionally including one or both of the first and second examples, determining the primary index value based on the first index value, the second index value, the pixel value, and each of the first and second sort values further comprises: normalizing the pixel value, the first sort value, and the second sort value, calculating a first difference between the normalized first sort value and the normalized pixel value, calculating a second difference between the normalized second sort value and the normalized pixel value, determining if the first difference is less than or equal to the second difference, in response to the first difference being less than or equal to the second difference, setting the first index value as the primary index value, and in response to the first difference being greater than the second difference, setting the second index value as the primary index value. In a fourth example of the method, optionally including one or more or each of the first through third examples, obtaining the mura value for each pixel comprises entering the primary index value and the pixel value into each of the first mura LUT and the second mura LUT to obtain a first mura value and a second mura value, and blending the first mura value and the second mura value to obtain the mura value. In a fifth example of the method, optionally including one or more or each of the first through fourth examples, commanding output of the display panel based on each mura value comprises sending each mura value to the display panel.

As used herein, an element or step recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property. The terms "including" and "in which" are used as the plain-language equivalents of the respective terms "comprising" and "wherein." Moreover, the terms "first," "second," and "third," etc. are used merely as labels, and are not intended to impose numerical requirements or a particular positional order on their objects.

This written description uses examples to disclose the invention, including the best mode, and also to enable a person of ordinary skill in the relevant art to practice the invention, including making and using any devices or systems and performing any incorporated methods. The patentable scope of the invention is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

The invention claimed is:

1. A method for controlling display of an image on a display panel of a display device, the method comprising:

determining a commanded brightness level for the display panel;

generating an index look-up table (LUT) and a mura LUT based on the brightness level and a relationship between pixel output and pixel value for each pixel of the display panel for each of a plurality of brightness levels, the relationship determined during a calibration phase and stored in memory of the display device;

determining an index value for each pixel of the display panel based on the index LUT;

determining a mura value for each pixel of the display panel based on the corresponding index value for that pixel, a pixel value for that pixel, and the mura LUT, where the pixel value for that pixel is determined based on the image; and sending a corrected pixel value for each pixel to the display panel.

2. The method of claim 1, wherein the corrected pixel value is an output value of the mura LUT.

3. The method of claim 1, wherein the corrected pixel value comprises the pixel value corrected by an output value of the mura LUT.

4. The method of claim 1, wherein determining an index value for each pixel of the display panel based on the index LUT comprises entering each spatial location of the image into the index LUT, and wherein the index LUT is configured to output a corresponding index value for each spatial location.

5. The method of claim 4, further comprising for each pixel that does not directly correspond to a respective spatial location of the index LUT, performing an interpolation of two or more index values from the index LUT.

6. The method of claim 1, wherein determining a mura value for each pixel of the display panel based on the corresponding index value for that pixel, a pixel value for that pixel, and the mura LUT comprises entering the corresponding index value for each pixel and the pixel value for each pixel as inputs into the mura LUT, and wherein the mura LUT is configured to output a corresponding mura value for each index value and pixel value.

7. A display device, comprising:

a display panel;

a processor; and memory storing instructions by the processor executable to, when displaying a digital image on the display panel:

determine a commanded brightness level for the display panel;

generating an index look-up table (LUT) and a mura LUT based on the brightness level and a relationship between pixel output and pixel value for each pixel of the display panel for each of a plurality of brightness values, the relationship determined during a calibration phase and stored in memory of the display device;

determine an index value for each pixel of the display panel based on output from an index look-up table (LUT);

determine a mura value for each pixel of the display panel based on the corresponding index value for that pixel, a pixel value for that pixel, and output from a mura LUT, where the pixel value for that pixel is determined based on the digital image, where the index LUT and the mura LUT are populated based on the commanded brightness level; and send a corrected pixel value for each pixel to the display panel.

8. The display device of claim 7, wherein the corrected pixel value is an output value of the mura LUT.

9. The display device of claim 7, wherein the corrected pixel value comprises the pixel value corrected by an output value of the mura LUT.

10. The display device of claim 7, wherein determining an index value for each pixel of the display panel based on the index LUT comprises entering each spatial location of the image into the index LUT, and wherein the index LUT is configured to output a corresponding index value for each spatial location.

11. The display device of claim 10, further comprising for each pixel that does not directly correspond to a respective spatial location of the image, performing an interpolation of two or more index values from the index LUT.

12. The display device of claim 7, wherein determining a mura value for each pixel of the display panel based on the corresponding index value for that pixel, a pixel value for that pixel, and the mura LUT comprises entering the corresponding index value for each pixel and the pixel value for each pixel as inputs into the mura LUT, and wherein the mura LUT is configured to output a corresponding mura value for each index value and pixel value.

13. The display device of claim 7, wherein the relationship is determined during the calibration phase by commanding the display panel to operate at a plurality of different pixel values at each of one or more brightness values, and wherein the relationship is determined by measuring, with a camera, pixel output for each pixel or group of pixels of the display panel at each commanded pixel value.

14. The display device of claim 13, wherein the plurality of different pixel values comprises two or three different pixel values, and wherein the one or more brightness values comprises one, two, or three brightness levels.

15. A method for controlling a display panel of a display device, comprising:

determining, from a representative set of test display panels, a plurality of key measurement operating points including one or more key pixel values at one or more key brightness values;

commanding the display panel to operate at each of the plurality of key measurement operating points;

obtaining a respective measurement of light output by the display panel at each of the plurality of key measurement operating points;

populating one or more index look-up tables (LUTs) and one or more correction LUTs based on each measurement of light output;

storing the populated one or more index LUTs and one or more correction LUTs in memory of the display device;

determining an index value based on output from an index LUT, the index LUT based on a commanded brightness of the pixel;

determining a correction value for each pixel of the display panel based on the corresponding index value for that pixel, a pixel value for that pixel, and output from a correction LUT, the correction LUT based on the commanded brightness of the pixel; and sending a corrected pixel value for each pixel to the display panel.

16. The method of claim 15, wherein obtaining each respective measurement of light output by the display panel comprises measuring the light output by the display panel using a CMOS imager.

17. The method of claim 16, further comprising automatically calibrating the CMOS imager by commanding the display panel to display a maximum brightness white image, measuring light output of the display panel with the CMOS imager while the display panel is displaying the maximum brightness white image to obtain calibration image information, and processing the calibration image information to generate an affine transform.

18. The method of claim 17, further comprising applying the affine transform to each respective measurement of light output by the display panel.

19. The method of claim 18, further comprising, after applying the affine transform, normalizing each respective measurement of light output by the display panel using the calibration image information, and averaging and downsampling each normalized respective measurement to a resolution of one of the one or more correction LUTs.

* * * * *